US011186460B2

(12) United States Patent
Komada et al.

(10) Patent No.: US 11,186,460 B2
(45) Date of Patent: Nov. 30, 2021

(54) SHEET FOLDING APPARATUS

(71) Applicants: Hiroki Komada, Yamanashi-ken (JP); Shoubu Kato, Yamanashi-ken (JP); Shogo Iwai, Yamanashi-ken (JP); Shinichi Ito, Yamanashi-ken (JP); Keiichi Atsumi, Yamanashi-ken (JP); Akihito Sakano, Yamanashi-ken (JP)

(72) Inventors: Hiroki Komada, Yamanashi-ken (JP); Shoubu Kato, Yamanashi-ken (JP); Shogo Iwai, Yamanashi-ken (JP); Shinichi Ito, Yamanashi-ken (JP); Keiichi Atsumi, Yamanashi-ken (JP); Akihito Sakano, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 96 days.

(21) Appl. No.: 16/706,164

(22) Filed: Dec. 6, 2019

(65) Prior Publication Data

US 2020/0223655 A1 Jul. 16, 2020

(30) Foreign Application Priority Data

| | | |
|---|---|---|
| Dec. 10, 2018 | (JP) | JP2018-230529 |
| Dec. 10, 2018 | (JP) | JP2018-230530 |
| Dec. 27, 2018 | (JP) | JP2018-245123 |
| Dec. 27, 2018 | (JP) | JP2018-245124 |
| Dec. 27, 2018 | (JP) | JP2018-245125 |

(51) Int. Cl.

| | |
|---|---|
| ***B65H 37/06*** | (2006.01) |
| ***B65H 45/16*** | (2006.01) |
| ***B65H 45/18*** | (2006.01) |

(52) U.S. Cl.

CPC ..... *B65H 45/162* (2013.01); *B65H 37/06* (2013.01); *B65H 45/18* (2013.01); *B65H 2801/27* (2013.01)

(58) Field of Classification Search

CPC .. B65H 37/06; B65H 45/18; B65H 2513/104; B65H 45/04; B65H 45/162

See application file for complete search history.

(56) References Cited

U.S. PATENT DOCUMENTS

| | | | | |
|---|---|---|---|---|
| 7,503,886 | B2 * | 3/2009 | Sekine | B65H 29/58 493/424 |
| 8,256,757 | B2 * | 9/2012 | Imazu | B65H 45/148 270/32 |
| 2017/0205751 | A1 * | 7/2017 | Hirano | G03G 15/6582 |
| 2020/0180894 | A1 * | 6/2020 | Enomoto | B65H 37/06 |
| 2020/0180897 | A1 * | 6/2020 | Shimizu | B65H 45/20 |

(Continued)

FOREIGN PATENT DOCUMENTS

| | | | |
|---|---|---|---|
| JP | H05-319686 | A | 12/1993 |
| JP | 2001-171907 | A | 6/2001 |
| JP | 2002-068583 | A | 3/2002 |

(Continued)

*Primary Examiner* — Patrick H Mackey

(74) *Attorney, Agent, or Firm* — Manabu Kanesaka

(57) ABSTRACT

In a sheet folding apparatus for folding a sheet, a sheet is pushed at a predetermined position thereof by a push member while the sheet is being conveyed by a conveyance roller. The predetermined position of the sheet is guided to the nip section of a folding roller pair. Then, the sheet is nipped at the predetermined position thereof and folded by the folding roller pair.

9 Claims, 16 Drawing Sheets

(56) References Cited

U.S. PATENT DOCUMENTS

| | | | | |
|---|---|---|---|---|
| 2020/0180898 | A1* | 6/2020 | Enomoto | B65H 45/18 |
| 2020/0180899 | A1* | 6/2020 | Enomoto | B65H 9/006 |

FOREIGN PATENT DOCUMENTS

| | | | | |
|---|---|---|---|---|
| JP | 2002068583 | A | * | 3/2002 |
| JP | 2005-067741 | A | | 3/2005 |
| JP | 2005067741 | A | * | 3/2005 |
| JP | 2008-207924 | A | | 9/2008 |
| JP | 2008-247531 | A | | 10/2008 |
| JP | 2012-111567 | A | | 6/2012 |
| JP | 2016-182998 | A | | 10/2016 |
| JP | 2016-216185 | A | | 12/2016 |
| JP | 2017-128411 | A | | 7/2017 |

* cited by examiner

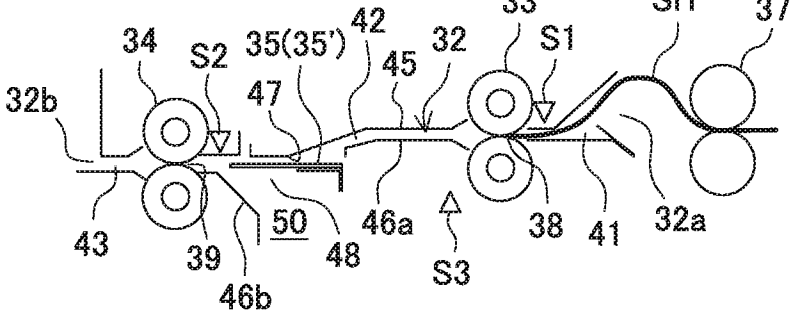
FIG. 7A
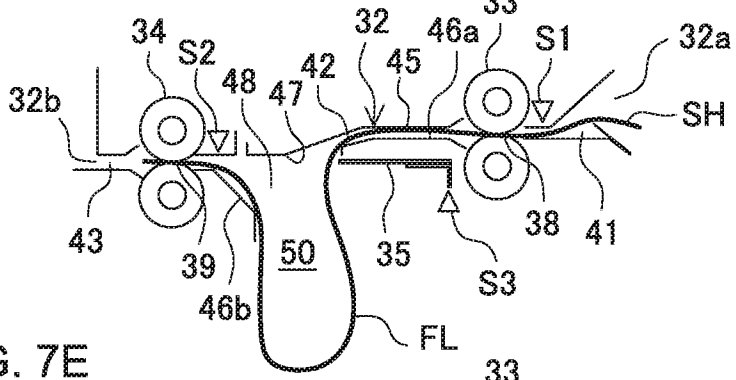
FIG. 7D
FIG. 7B
FIG. 7E
FIG. 7C
FIG. 7F

SHEET FOLDING APPARATUS

BACKGROUND OF THE INVENTION

1. Field of the Invention

This invention relates to a sheet folding apparatus for executing a sheet folding process.

2. Description of Related Art

To date, sheet folding apparatus that execute a sheet folding process at a predetermined position of a sheet that bears an image formed by an image forming apparatus, which may typically be a copying machine or a printer, are known. Popular sheet folding processes include those of half fold with which a sheet is folded into two equal halves, those of tri-fold with which a sheet is inwardly folded into three parts and those of Z-fold with which a sheet is inwardly folded first and then outwardly folded.

Paper folding apparatus comprising a horizontal upper guide plate, a feed roller pair arranged on the upstream side of the upper guide plate, a paper folding roller pair arranged on the downstream side of the upper guide plate, wherein a piece of paper guide/deflection member (namely a push member) is arranged on the upstream side of the paper folding roller pair, are known (see, inter alia, JP 2002-68583 A). With such an apparatus, the piece of paper guide/deflection member is moved from a second position located diagonally downward relative to the paper folding roller pair on the upstream side of the latter to a first position for bringing the leading edge of the piece of paper to be folded close to the draw-in port of the paper folding roller pair and the piece of paper is made to be drawn into the piece of paper draw-in port at a predetermined position of the piece of paper that is hanging down into a space located in front of the paper folding roller pair to fold the piece of paper for half fold or Z-fold.

Furthermore, sheet processing apparatus comprising a lower guide plate, an upper guide plate, the lower guide plate and the upper guide plate being arranged vis-à-vis to produce a conveyance path therebetween, a sheet conveyance roller arranged on the upstream side of the conveyance path, a sheet bending roller arranged on the downstream side of the conveyance path, a press member (namely a push member) movable between a first position where it closes the notch formed on the lower guide plate and a second position, or a retreat position arranged on the upstream side of and located diagonally downward relative to the notch to fold a sheet for half fold or Z-fold are also known (see, inter alia, JP 2005-67741 A). The press member is driven to move on the sheet that is being processed along the upper guide plate from the second position to the first position in a state where the sheet that is hanging down from the notch, which is made open between the sheet conveyance roller and the sheet bending roller, is pressed against the upper guide plate by the front end side roller of the press member, and the sheet is guided so as to make the position of the sheet to be bent to be brought to the nip position of the sheet bending roller and then actually bend the sheet by the rotatory motion of the sheet bending roller.

With a known apparatus described in JP 2002-68583 A, a vertical large gap arises between the piece of paper guide/deflection member and the upper guide plate during the time when the piece of paper guide/deflection member is moved toward the first position located close to the piece of paper draw-in port, while pushing the piece of paper by means of its front end (small roller). For this reason, there arises a risk that the upstream side part of the sheet of paper relative to the front end of the piece of paper guide/deflection member droops downward. This tendency of drooping downward particularly remarkably appears on a thin piece of paper that is soft and shows a low rigidity. Then, the position of the piece of paper at which it is pushed by the piece of paper guide/deflection member can be shifted while the position is being moved toward the piece of paper draw-in port from the predetermined position to an upstream side position or a downstream side position as viewed in the sheet conveyance direction.

On the other hand, the downstream side part of the sheet of paper from the position thereof where it is pushed by the piece of paper guide/deflection member is hanging down from the front end of the sheet of paper guide/deflection member. For this reason, there arises a risk that the sheet of paper and the front end of the sheet of paper guide/deflection member are made to slide or displaced relative to each depending on the characteristics (such as the surface smoothness and the rigidity) and the dimensions of the sheet of paper and the sheet conveyance direction. Such a positional shift of the piece of paper guide/deflection member relative to the predetermined position of the sheet of paper directly results in a positional shift of the fold or folds of the sheet of paper. Then, as a result, there arises irregularity of folded positions and variations in the dimension as viewed in the sheet conveyance direction among the sheets of paper that have been subjected to the sheet folding process to give rise to a problem of impairing the appearance of the folded sheets.

With a known apparatus described in JP 2005-67741 A, the sheet of paper being subjected to a sheet folding process is prevented from sagging at the upstream side part thereof relative to the front end of the press member by moving the position of the sheet at which the sheet is to be bent to the first position where it is guided to the nip position of the sheet bending roller in a state where the sheet is pressed against the upper guide plate by the press roller at the front end of the press member. However, the press member is diagonally moved from the first position to the retreat position (second position) located diagonally downward on the upstream side and hence a vertical gap is produced between the press member and the upper guide plate on the upstream side of the press roller as in the instance of the Patent Literature 1 (JP 2002-68583 A). For this reason, the sheet can slide relative to the upper guide plate and/or the press roller depending on the rigidity and/or some other characteristics of the sheet. Then, as in the instance of a known apparatus described in JP 2002-68583 A, the sheet can sag in the gap between the press member and the upper guide plate. Then, as a result, there arises irregularity of folded positions and variations in the dimension as viewed in the conveyance direction among the sheets of paper that have been subjected to the sheet folding process to give rise to a problem of impairing the appearance of the folded sheets.

SUMMARY OF THE INVENTION

This invention provides a sheet folding apparatus for folding a sheet, the apparatus comprising: a folding roller pair for nipping a sheet at a predetermined position and folding the sheet; a conveyance roller for conveying the sheet to the folding roller pair; a push member to be moved from a retreat position separated from the sheet to a push position for pushing the sheet at the predetermined position and causing the folding roller pair to nip the sheet; and a control section for controlling the operation of driving the conveyance roller and the operation of moving the push member; the control section operating so as to move the push member to the push position while conveying the sheet by means of the conveyance roller.

BRIEF DESCRIPTION OF THE DRAWINGS

FIG. 7A through 7F are schematic cross-sectional views of the sheet folding apparatus, sequentially showing different steps of the folding process of the sheet folding apparatus.

DETAILED DESCRIPTION OF THE PREFERRED EMBODIMENT

Now, a preferred embodiment of the present invention will be described by referring to the accompanying drawings.

[Image Forming System]

Figure 1:
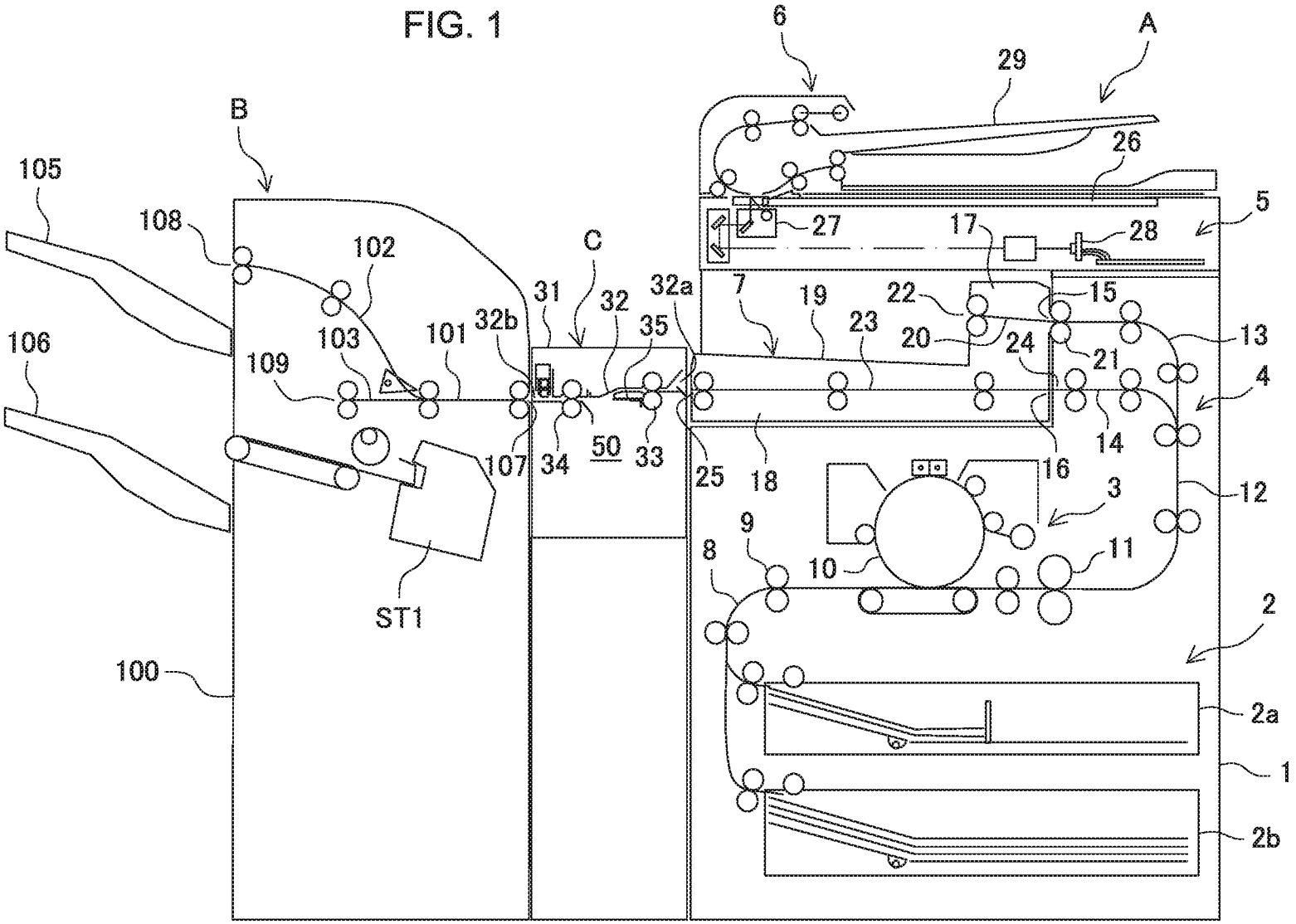
FIG. 1 is a schematic graphic illustration of an image forming system to which the present invention is applied, showing the overall configuration of the system.

FIG. 1 shows the overall configuration of an image forming system to which the present invention is applied. The image forming system illustrated in FIG. 1 comprises an image forming apparatus A, a sheet post-processing apparatus B and a sheet folding apparatus C connected between the former two apparatus. The sheet on which an image has been formed by the image forming apparatus A is conveyed on by way of the sheet folding apparatus and contained in a discharge tray by the sheet post-processing apparatus B. Now, the image forming apparatus A, the sheet post-processing apparatus B and the sheet folding apparatus C will sequentially be described below.

[Image Forming Apparatus]

The image forming apparatus A is a known type apparatus designed to form an image on a sheet by means of a known electrostatic printing mechanism. It includes a sheet feeding section 2, an image forming section 3, a sheet discharge section 3 and a control section (not shown) contained in the housing 1 of the apparatus. An image reading section 5 formed by using a scanner unit and an automatic original feeding section 6 placed on the image reading section 5 are integrally arranged in an upper part of the housing 1 of the image forming apparatus. The image forming apparatus A of this embodiment is of the so-called internal (in-drum) sheet discharge type. Referring to FIG. 1, a conveyance relay unit 7 is arranged in the sheet discharge space, which shows a U-shaped front view and is a large space defined by the image forming section 3, the sheet discharge section 4 and the image reading section 5. Note that the electrostatic printing mechanism of the image forming apparatus A can be replaced by an inkjet image forming type mechanism, an offset printing type mechanism, a silk printing type mechanism or some other mechanism selected from a variety of image forming mechanisms.

A plurality of sheet feeding cassettes 2*a*, 2*b* for different sheet sizes are removably arranged at the sheet feeding section 2 in the housing 1 of the apparatus A. The sheet feeding section 2 that contains sheets on which images are to be formed sends out one or more sheets of the size indicated by the control section from the corresponding one of the sheet feeding cassettes onto the sheet feeding route 8. A registration roller 9 is arranged on the sheet feeding route 8 and the leading edge of the sheet or each of the sheets is squarely placed at the right position by the registration roller and the sheet or each of the sheets is fed to the image forming section 3 arranged on the downstream side at a predetermined timing.

The image forming section 3 has an electrostatic drum 10 and a printing head, a developer, a transfer charger and other components that are arranged around the electrostatic drum 10. The printing head is typically formed by using a laser emitter. It forms an electrostatic latent image on the electrostatic drum 10. Then, the developer applies toner ink onto the electrostatic latent image to turn the electrostatic latent image into a toner image, which toner image is then transferred onto a sheet by the transfer charger. The sheet onto which the toner image has been transferred is then conveyed to a fixing device 11, where it is heated and pressure is applied to it to fix the toner image. Thereafter, the sheet is carried out onto the sheet discharge route 12 of the sheet discharge section 4.

The sheet discharge route 12 is branched on the downstream side thereof to a first sheet discharge route 13 shown as an upper route in FIG. 1 and a second sheet discharge route 14 shown as a lower route in FIG. 1. The first sheet discharge route 13 and the second sheet discharge route 14 are respectively connected to a first sheet discharge port 15 that is formed on the upper side and a second sheet discharge port 16 that is formed on the lower side, those of which are open to the above-described sheet discharge space.

A sheet circulation route (not shown) may be arranged in the sheet discharge section 4. Such a sheet circulation route may typically serve to connect the sheet discharge route 12 to the sheet feeding route 8 on the downstream side of the fixing device 11 and on the upstream side of the registration roller 9. A sheet can be made to bear a front surface side image and a rear surface side image in the following way. The sheet on which an image has been formed and that is sent out from the image forming section 3 onto the sheet discharge route 12 is then sent back onto the sheet circulation route by reversing the rotatory motion of the sheet discharge roller arranged on the sheet discharge route 12 and the sheet is turned upside down and sent further back to the image forming section 3.

As shown in FIG. 1, the conveyance relay unit 7 shows a substantially L-shaped front view and has a first relay section 17 that extends upward at the right end of the above-described sheet discharge space and a second relay section 18 that transversely crosses the sheet discharge space substantially over the entire width of the space and extends to the left side surface of the apparatus housing 1. The upper surface of the second relay section 18 operates as a substantially flat sheet discharge tray 19 in the sheet discharge space.

The first relay section 17 has a first relay path 20 arranged in the inside thereof and the first sheet entrance 21 thereof is arranged so as to be connected to the first sheet discharge port 15 of the sheet discharge section 4, and the first sheet exit 22 thereof is arranged so as to be open to the sheet discharge space at a position located above the sheet discharge tray 19. A carry-out roller that is driven by the motor contained in the first relay section 17 is arranged at a position located near the first sheet exit 22 on the first relay path 20. The sheet bearing an image formed thereon and being conveyed from the sheet discharge section 4 by way of the first sheet discharge route 13 is carried out onto the sheet discharge tray 19 in the sheet discharge space by means of the carry-out roller and by way of the first relay path 20.

The second relay section 18 has a second relay path 23 arranged in the inside thereof and the second sheet entrance 24 thereof is arranged so as to be connected to the second sheet discharge port 16 of the sheet discharge section 4. The second sheet exit 25 of the second relay path 23 is open to a surface which is substantially an extension of the left side surface of the apparatus housing 1 and connected to the carry-in port of the sheet folding apparatus C as will be described in greater detail hereinafter. A plurality of conveyance rollers that are driven by the motor contained in the second relay section 18 to convey sheets are arranged on the second relay path 23. The sheet bearing an image formed thereon and being conveyed from the sheet discharge section 4 by way of the second sheet discharge route 14 is sent into the sheet folding apparatus C by the above-described sheet conveyance rollers by way of the second relay path 23.

The image reading section 5 includes a platen 26 for receiving an original document, a reader carriage 27 that moves along the platen, and an optical reading means 28, which is typically formed by using a CCD device. The original document on the platen 26 is scanned and optically read out by the reader carriage 27 and the optical image formed as a result of the optical reading operation is photoelectrically converted into image data by the optical reading means 28. The automatic sheet feeding section 6 automatically feeds the original document placed on the sheet feeding tray 29 to the platen 26.

With the above-described arrangement, the image forming apparatus A reads out the original document sent from the original document sending section 5 by means of the image reading section 4 and forms an image on the sheet sent from the sheet feeding section 3 by means of the image forming section 2 according to the obtained image data. When the sheet bearing an image formed thereon is not to be subjected to a folding process by the sheet folding apparatus C and post-processing by the sheet post-processing apparatus B, the sheet is conveyed from the sheet discharge section 4 by way of the first sheet discharge route 13 and the first relay path 20 and carried out onto the sheet discharge tray 19 in the sheet discharge space. When, on the other hand, the sheet bearing an image formed thereon is to be subjected to a folding process and/or post processing, the sheet is conveyed from the sheet discharge section 4 by way of the second sheet discharge route 14 and sent into the sheet folding apparatus C by way of the second relay path 23.

[Sheet Post-Processing Apparatus]

As shown in FIG. 1, the sheet post-processing apparatus B includes a first conveyance path 101 for conveying a sheet from the sheet folding apparatus, second and third conveyance paths 102, 103 that are branched from the first conveyance path, post-processing equipment including a staple unit ST1, and a binding processing tray 104, all of the above-listed components of the sheet post-processing apparatus B being contained in the housing 100 of the apparatus. First and second sheet discharge trays 105, 106 for accumulating and containing the sheets discharged from the sheet post-processing apparatus B are arranged on one of the lateral surfaces (the left-side lateral surface in FIG. 1) at respective positions are vertically separated from each other. The sheet post-processing apparatus B is arranged such that the sheet carry-in port 107 of its first conveyance path 101 is connected to the sheet discharge port of the sheet folding apparatus C, which will be described in greater detail hereinafter.

The first sheet discharge tray 105 is arranged below the sheet discharge port 108, which is open at the above-identified lateral surface of the housing 100, of the second conveyance path 102. When the sheet sent from the sheet folding apparatus C is not to be subjected to a binding process at the staple unit ST1 and/or some other post-processing in the sheet post-processing apparatus B, the sheet is conveyed from the first conveyance path 101 to the second conveyance path 102 and directly discharged from the sheet discharge port 108 onto the first sheet discharge tray 105.

The sheet discharge port 109 of the third conveyance path 103 is arranged above the binding processing tray so as to be exposed to the sheet loading surface of the binding processing tray 104. When the sheet sent from the sheet folding apparatus C is to be subjected to a binding process at the staple unit ST1, the sheet is conveyed from the first conveyance path 101 to the third conveyance path 103 and discharged from the sheet discharge port 109 thereof to the sheet loading surface of the binding processing tray 104. The plurality of sheets accumulated on the binding processing tray 104 are subjected to a binding process and bound into a bundle of sheets by the staple unit ST1. Then, the bundle of sheets is conveyed from the binding processing tray and discharged from the downstream side end thereof onto the second sheet discharge tray 106 located below the downstream side end thereof.

[Overall Configuration of Sheet Folding Apparatus]

Figure 2:
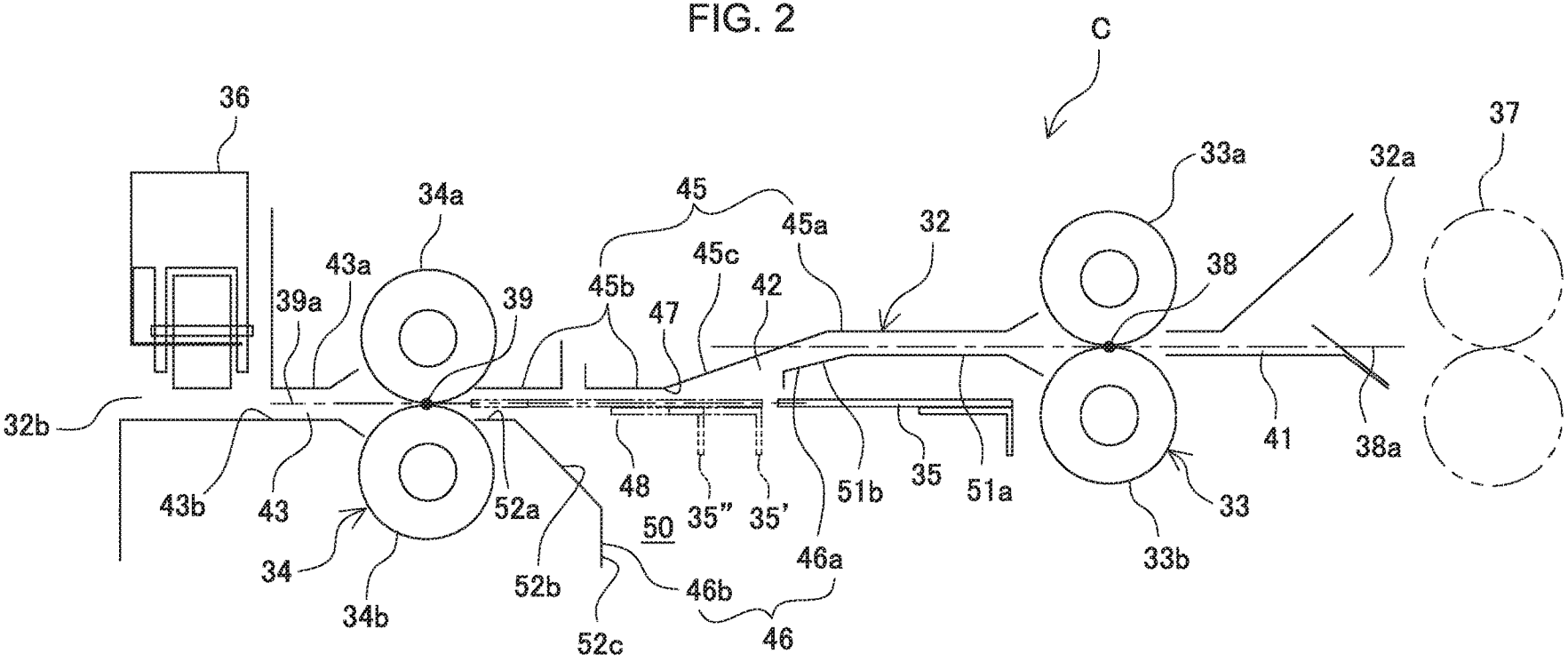
FIG. 2 is a schematic graphic illustration of a sheet folding apparatus according to the present invention, showing the configuration of the apparatus.

As shown in FIG. 2, a conveyance route 32 extending from the sheet carry-in port 32*a* on the side of the image forming apparatus A to the sheet discharge port 32*b* on the side of the sheet post-processing apparatus B is formed in the inside of the housing 31 of the sheet folding apparatus C. A sheet registration roller pair 33, which is arranged on the upstream side as viewed in the sheet conveyance direction, a folding roller pair 34, which is arranged on the downstream side, and a push plate (veneer) 35 arranged between the above-described two roller pairs, are provided on the conveyance route 32. As described above, the sheet folding apparatus C is arranged such that its sheet carry-in port 32*a* is connected to the second sheet exit 25 of the conveyance relay unit 7 arranged in the image forming apparatus A and its sheet discharge port 32*b* is connected to the sheet carry-in port 107 of the sheet post-processing apparatus B.

Additionally, if desired, an additional folding mechanism 36 may be arranged near the sheet discharge port 32*b* of the conveyance route 32. It is a practice well known to those who are skilled in the art to arrange an additional folding mechanism for pressing the one or more folds of a sheet on the downstream side of the folding processing mechanism for the purpose of reliably maintaining the fold or folds of the sheet that is being conveyed in a folding processing mechanism, which may typically be a sheet folding apparatus C.

[Registration Roller Pair]

The registration roller pair 33 includes an upper side drive roller 13*a* and a lower side follower roller 33*b* that are arranged vis-a-vis with the conveyance route 32 interposed between them as shown in FIG. 2. The roller surface of the follower roller 33*b* is pressed against the roller surface of the drive roller 33*a* typically by an appropriate spring means (not shown) so that, as a result, as the drive roller 33*a* is driven to rotate by the registration motor, which will be described in greater detail hereinafter, the follower roller 33*b* rotates to follow the rotatory motion of the drive roller 33*a*.

The leading edge of the sheet that is sent out from the conveyance relay unit 7 of the image forming apparatus A to the discharge roller pair 37 arranged near the second sheet exit 25 is placed at the right position as the leading edge of the sheet is made to contact the nip section 38 that is the press applying section of the roller surfaces of the registration roller pair 33 whose rotatory motion is suspended. Thus. the leading edge of the sheet is placed at the right position to eliminate the oblique motion, if any, and then the sheet is conveyed through the conveyance route 32 toward the folding roller pair 34 as the registration roller pair 33 is driven to rotate again at a predetermined timing.

In a different embodiment, the registration roller pair 33 may be substituted by a discharge roller (which corresponds to the discharge roller pair 37 in FIG. 2) for discharging the sheet from the image forming apparatus A to the sheet folding apparatus C. With such an arrangement, the number of the components of the sheet folding apparatus C can be reduced to reduce the manufacturing cost thereof and the overall apparatus can be downsized when viewed in the sheet conveyance direction. If such is the instance, the discharge roller pair 37 is preferably made to take the role of placing the leading edge of the sheet that is being carried into the conveyance route 32 at the right position as described above.

[Folding Roller Pair]

The folding roller pair 34 includes an upper folding roller 34*a* and a lower folding roller 34*b* that are arranged vis-a-vis with the conveyance route 32 interposed between them as shown in FIG. 1. Both of the rollers 34*a*, 34*b* are urged typically by respective spring means (not shown) so as to make their roller surfaces contact and press each other for the purpose of nipping the leading edge and the fold or folds of the sheet being sent from the registration roller pair 33 and executing a folding process as will be described in greater detail hereinafter and also driven to rotate in the sheet conveyance direction in synchronism with each other by a common folding roller drive motor, which will also be described in greater detail hereinafter, while the surfaces of the two rollers are pressing each other as described above.

The folding roller pair 34 is arranged such that the nip section 38 of the registration roller pair 33 is located above the tangential line 39*a* that passes the nip section 39 of the folding roller pair 34, which nip section 39 is the position where the surfaces of the rollers of the folding roller pair 34 contact and press each other. In the embodiment shown in FIG. 2, both the tangential line 39*a* and the tangential line 38*a* that passes through the nip section 38 of the registration roller pair 33 extend substantially horizontally and are vertically separated from each other at a certain distance such that the tangential line 38*a* extends above the tangential line 39*a*.

[Conveyance Route]

As shown in FIG. 2, the conveyance route 32 includes a sheet carry-in path 41 that extends along the sheet conveyance direction from the sheet carry-in port 32*a* to the registration roller pair 33, a conveyance path 42 that starts from the registration roller pair 33 and terminates at the folding roller pair 34 and a sheet carry-out path 43 that starts from the folding roller pair 34 and terminates at the sheet carry-out port 32*b*.

The sheet carry-in path 41 has an upper carry-in guide 41*a* and a lower carry-in guide 41*b* that are arranged along the sheet conveyance direction to face each other so as to guide the leading edge of the sheet that is carried in to the nip section 38 of the registration roller pair 33. The upper carry-in guide 41*a* is turned upward from a position located near the registration roller pair 33 toward the inlet side of the sheet carry-in path 41 in order to secure a large space for receiving the sheet that is sent out from the upstream side toward the discharge roller pair 37 so as to allow the sheet to be warped to form a loop on the sheet carry-in path 41 when the leading edge of the sheet is made to contact the nip section 38 of the registration roller pair 33 to place itself at the right position as described above.

As shown in FIG. 2, the conveyance path 42 has an upper conveyance guide 45 and a lower conveyance guide 46 that are arranged along the sheet conveyance direction to vertically face each other so as to guide the sheet whose leading edge has been placed at the right position by the registration roller pair 33 to the nip section 39 of the folding roller pair 34. Thus, the sheet is conveyed on the conveyance path 42 in a state where the sheet is restricted from the opposite sides in the thickness direction, from upside and downside in this embodiment, by the upper and lower conveyance guides 45, 46.

The tangential line 38*a* passing through the nip section 38 of the registration roller pair 33 and the tangential line 39*a* passing through the nip section 39 of the folding roller pair 34 are made to extend horizontally and displaced vertically as described above and hence the upper conveyance guide 45 is made to include a first horizontal part 45*a* that extends horizontally toward the downstream side along the tangential line 38*a*, a second horizontal part 45*b* that extends horizontally toward the upstream side along the tangential line 39*a* and an inclined part 45*c* that is inclined downwardly from the upstream side toward the downstream side as if it connects the two tangential lines 38*a*, 39*a*.

As shown in FIG. 2, the inclined part 45*c* extends linearly from the upstream side end of the second horizontal part 45*b* toward a diagonally upward right side position in FIG. 2. The inclined part 45*c* and the second horizontal part 45*b* linearly intersect each other to show a relatively large obtuse angle at the junction thereof so that a somewhat downwardly protruded portion 47 is produced on the conveyance path 42. Similarly, the inclined part 45*c* and the first horizontal part 45*a* linearly intersect each other to show a relatively large obtuse angle at the junction thereof.

In an another embodiment, the junction of the inclined part 45*c* and the second horizontal part 45*b* can be made to be a curved junction. In such an instance, the protruded portion 47 is made to be a somewhat downwardly protruded curved portion. The junction of the inclined part 45*c* and the first horizontal part 45*a* can also be made to be a curved junction. In another different embodiment, the second horizontal part 45*b* and the inclined part 45*c* of the upper conveyance guide 45 can be formed by using separate members but a protruded portion 47 can also be produced at the junction thereof.

In this embodiment, the first horizontal part 45*a*, the inclined part 45*c* and the upstream side portion of the second horizontal part 45*b* are formed by a first continuous upper conveyance guide member and the downstream side part of the second horizontal part 45*b* is formed by a second upper conveyance guide member that is different from the first upper conveyance guide member. The first and second upper conveyance guide members are substantially continuously arranged so as not to obstruct the sheet conveyance operation on the conveyance path 42. Besides, the first upper conveyance guide member can be formed by using a plurality of guide members that are substantially continuously arranged and the position of the boundary line between the first upper conveyance guide member and the second upper conveyance guide member is not limited to the one shown in FIG. 2. In other words, any of various different positions may be selected for the boundary line of the first and second upper conveyance guide members.

The lower conveyance guide 46 includes a first lower guide part 46*a* that extends along the sheet conveyance direction from the registration roller pair 33 toward the downstream side down to a predetermined position and a second lower guide part 46*b* that extends along the sheet conveyance direction from the folding roller pair 34 toward the upstream side up to a predetermined position. The first and second lower guide parts 46*a*, 46*b* are separated from each other so as to define a large gap 48 between them as viewed in the sheet conveyance direction and rigidly fitted to the housing 31. The gap 48 between the first and second lower guide parts 46*a*, 46*b* is selectively held open or closed by means of the push plate 35 that can horizontally be moved back and forth relative to the nip section 39 of the folding roller pair 34 as will be described hereinafter.

As shown in FIG. 2, a relatively large loop forming space 50 is provided under the gap 48 of the lower conveyance guide 46. As the push plate 35 is retreated (as indicated by a solid line in FIG. 2) to open the gap 48, the sheet on the conveyance path 42 is allowed to hang down from the gap 48 into the loop forming space 50. As the push plate 35 is moved forward (as indicated by a fictitious line in FIG. 2) to close the gap 48, the sheet sent out from the registration roller pair 33 can be conveyed along the conveyance path 42 toward the folding roller pair 34 without hanging down into the loop forming space 50.

The first lower guide part 46*a* includes a first horizontal guide section 51*a* that extends horizontally from the registration roller pair 33 toward the downstream side so as to generally face the first horizontal part 45*a* of the upper conveyance guide 45 and a first inclined guide section 51*b* that extends therefrom further toward the downstream side and is inclined so as to generally face the inclined part 45*c* of the above-described upper conveyance guide down to a middle point of the inclined part 45*c*. The downstream side end of the first inclined guide section 51*b* defines the hanging down start position of the sheet when the gap 48 is opened. In this embodiment, the downstream side end of the first inclined guide section 51*b* is arranged so as to be located above the tangential line 39*a* that passes through the nip section 39 of the folding roller pair 34.

The second lower guide part 46*b* includes a second horizontal guide section 52*a* that extends horizontally from the folding roller pair 34 toward the upstream side, a second inclined guide section 52*b* that extends from the second horizontal guide section 52*a* and is downwardly inclined toward the upstream side and a vertical guide section 52*c* that extends from the second inclined guide section substantially vertically downwardly. The second horizontal guide section 52*a* cooperates with the second horizontal part 45*b* of the upper conveyance guide 45 to guide the leading edge of the sheet to the nip section 39 of the folding roller pair 34, restricting the sheet in the vertical direction from upward and from downward in the thickness direction. The second inclined guide section 52*b* is inclined toward the loop forming space so as to guide the sheet that is hanging down into the loop forming space 50 to the nip section 39 of the folding roller pair 34. The vertical guide section 52*c* separates the sheet that is hanging down into the loop forming space 50 from the side of the folding roller pair 34 in cooperation with the second inclined guide section 52*b*, while securing the dimensions of the loop forming space 50.

When the push plate 35 is at the retreat position, as the sheet that is sent out from the registration roller pair 33 onto the conveyance path 42 rides over the downstream side end of the first inclined guide section 51*b*, the sheet linearly hangs down from its leading edge into the loop forming space 50 by way of the gap 48 that is now opened. On the other hand, when the gap 48 is opened in a state where the leading edge of the sheet is nipped by the folding roller pair 34 and the rotatory motion of the folding roller pair 34 is suspended, the sheet on the conveyance path 42 is warped to form a loop and hangs down into the loop forming space 50 by way of the gap 48 as will be described in greater detail hereinafter.

Differently stated, the conveyance path 42 includes a first route section for sending out the sheet from the registration roller pair 33, a second route section that can selectively open or close the conveyance path 42 relative to the lower loop forming space 50 and a third route section for guiding the sheet to the nip section 39 of the folding roller pair 34. The upper parts of the first through third route sections that are to face the upper surface of the sheet are made to substantially continuously extend in the sheet conveyance direction by the upper conveyance guide 45 that includes the first and second upper conveyance guide members as described above. As for the lower parts of the first through third route sections, the lower part of the first route section is formed by the rigidly secured first lower guide part 45*a* and the lower part of the third route section is formed by the rigidly secured second lower guide part 46*b*, whereas the lower part of the second route section is formed by the gap 48 that can be opened or closed by moving the push plate 35.

In a different embodiment, the first route section can be formed only by a horizontal guide part without using the first inclined guide section 51*b*. In FIG. 2, the transitional position between the inclined part 45*c* and the second horizontal part 45*b* of the upper conveyance guide 45 is confined within the range of the gap 48 of the above-described second route section. However, the present invention is by no means limited to such an arrangement. With regard to the second lower guide part 46*b*, the second inclined guide section 52*b* can be downsized from the one shown in FIG. 2 or omitted so long as the sheet that is hanging down into the loop forming space 50 can reliably be guided to the nip section 39 of the folding roller pair 34. Similarly, the vertical guide section 52*c* can also be downsized or omitted so long as a sufficiently large size can be secured for the loop forming space 50.

The sheet carry-out path 43 includes an upper carry-out guide 43*a* and a lower carry-out guide 43*b* that are arranged along the sheet conveyance direction respectively at an upper position and at a lower position so as to face each other and guide the sheet that has been subjected to a folding process to the sheet carry-out port 32*b*. An additional folding (press) mechanism 36 having a plurality of rollers for additionally pressing the fold or folds of the sheet that has been subjected to a folding process and moving the rollers above the lower carry-out guide 43*b*, for example, in the width direction of the sheet that is orthogonal to the sheet conveyance direction is arranged in front of the sheet carry-out port 32*b*.

[Push Plate]

As shown in FIGS. 2 and 3, the push plate 35 is formed by a flat plate member extending in the sheet width direction on the conveyance path 42. The push plate 35 is arranged horizontally so as to be substantially flush with the nip section 39 of the folding roller pair 34. Additionally, the push plate 35 is horizontally movably arranged between the retreat position located below the first lower guide part 46*a* as indicated by the sold line in FIG. 2 and the guide position and the push position that are indicated respectively by the imaginary lines 35' and 35".

When the push plate 35 is placed at the retreat position, the gap 48 of the lower conveyance guide 46 is completely made open and the second route section of the conveyance path 42 is also made open relative to the loop forming space 50 arranged below the second conveyance route section. Therefore, the sheet on the conveyance path 42 can hang down from the conveyance path 42 into the loop forming space 50 as will be described in greater detail hereinafter.

At the guide position as indicated by the imaginary line 35', the push plate 35 completely closes the gap 48 of the lower conveyance guide 46 and, at the same time, becomes to constitute a part of the lower conveyance guide 46 located below the upper conveyance guide 45 so as to face the latter. With this arrangement, the sheet on the conveyance path 42 is guided on the second route section without hanging down into the loop forming space 50 and conveyed from the first route section to the third route section.

At the push position that is indicated by the imaginary line 35", the push plate 35 gets into between the second horizontal part 45*b* of the upper conveyance guide 45 and the second horizontal guide section 52*a* of the second lower guide part 46*b* on the above-described third route section. This push position is the position where the push plate 35 moves and sends the fold or folds of the sheet to the nip section 39 of the folding roller pair 34 by means of its front end.

Figure 4:
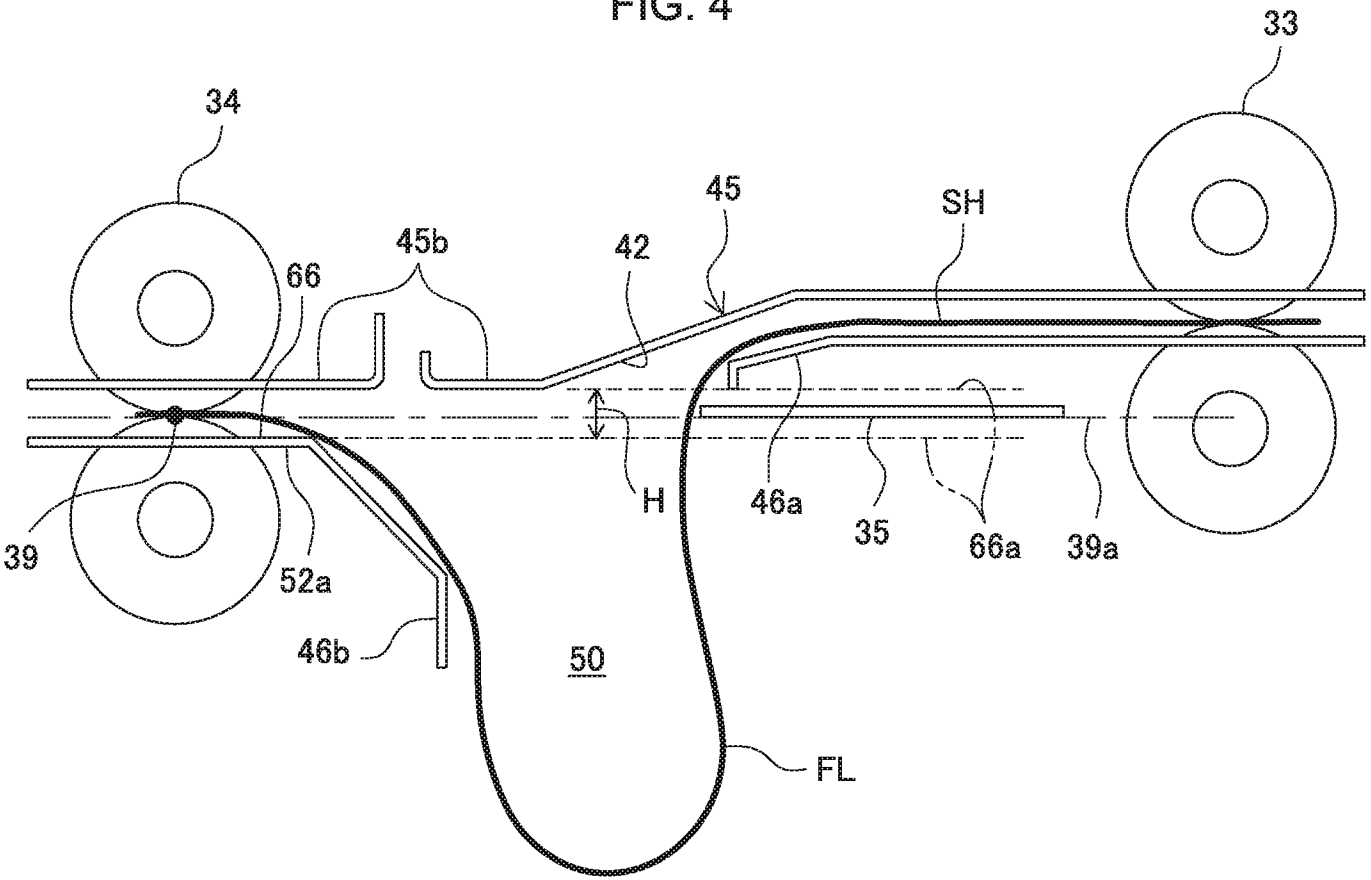
FIG. 4 is a schematic graphic illustration of a suitable exemplary positional arrangement of the push member when it is located in the retreat position.

FIG. 4 specifically shows a suitable exemplar positional arrangement of the push plate 35 at the above-described retreat position in an enlarged view. As shown in FIG. 4, a horizontal gap having a height of H is defined between the second horizontal part 45*b* of the upper conveyance guide 45 and the second horizontal guide section 52*a* of the second lower guide part 46*b* of the lower conveyance guide 46 that faces the second horizontal part 45*b*. Then, as a result, the third route section of the conveyance path 42 is made to have a linear section 66 that extends horizontally and linearly from the folding roller pair 34 on the upstream side thereof.

The height H of the linear section 66 is so determined that several sheets that are laid one on the other can smoothly pass between the second horizontal part 45*b* of the upper conveyance guide 45 and the second horizontal guide section 52*a* of the lower conveyance guide 46 both on the upper side and under the lower side of the push plate 33 located in the liner section 66. In this embodiment, the height H is determined to be equal to 2 mm, for example, to accommodate two sheets that are laid one on the other and to be used in the image forming apparatus A so as to allow a sheet that is folded into two to pass through the linear section 66. Then, as a result, the push plate 35 can smoothly move in the third route section to the above-described push position, while pushing the sheet by means of its front end, in a holding process, which will be described in greater detail hereinafter.

Preferably, the push plate 35 is so arranged at the push position that its front end comes close to the nip section 39 of the folding roller pair 34 in the gap of the linear section 66 of the third route section. For this reason, the push plate 35 shown in FIG. 4 is arranged at the retreat position horizontally within the vertical range of height H on the extension line 66*a* that is extended on the upstream side from the linear section 66. The push plate 35 moves horizontally and linearly from this retreat position with its front end directed toward the nip section 39 of the folding roller pair 34.

In greater detail, referring to FIG. 4, the push plate 35 of this embodiment is arranged on the tangential line 39*a* extending from the nip section 39 on the upstream side or at a position located slightly below the tangential line 39*a*. With this arrangement, the front end of the push plate 35 that is located at the push position can conveniently be brought closer to the nip section 39.

The retreat position of the push plate 35 is not necessarily be confined within the vertical range of the height H on the extension line 66*a* of the linear section 66. A position different from the position shown in FIG. 4 can be selected for the retreat position so long as the push plate 35 that is moving toward the folding roller pair 34 can move horizontally along the upper conveyance guide 45 in the third route section and its front end can be brought close to the nip section 39 at the above-described push position.

Figure 3A:
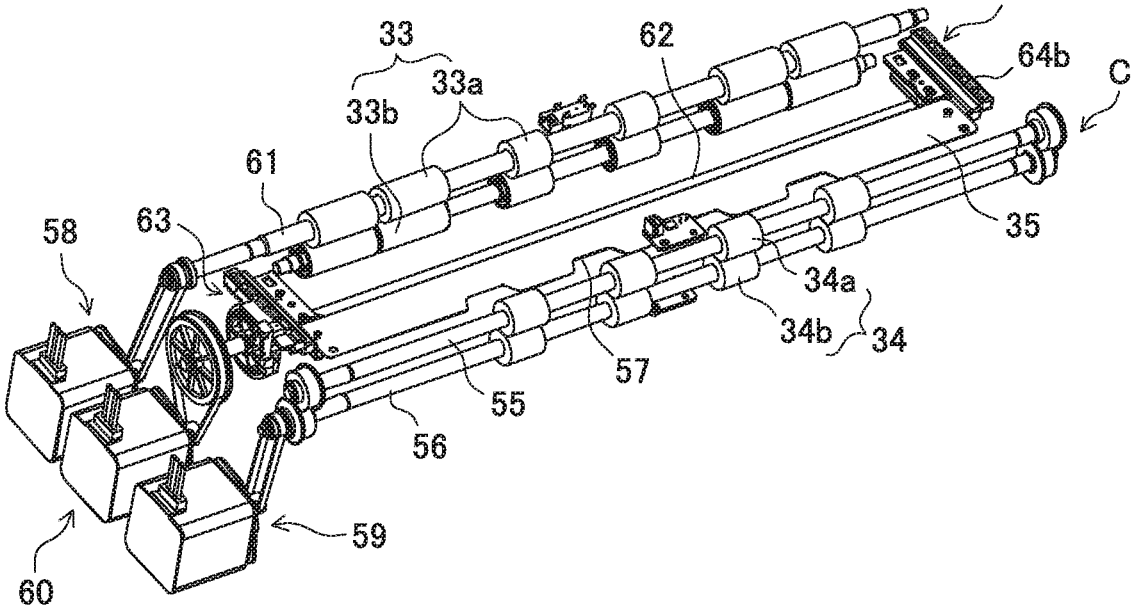
FIG. 3A is a schematic perspective view of the entire drive mechanism of the sheet folding apparatus of FIG. 2
Figure 3B:
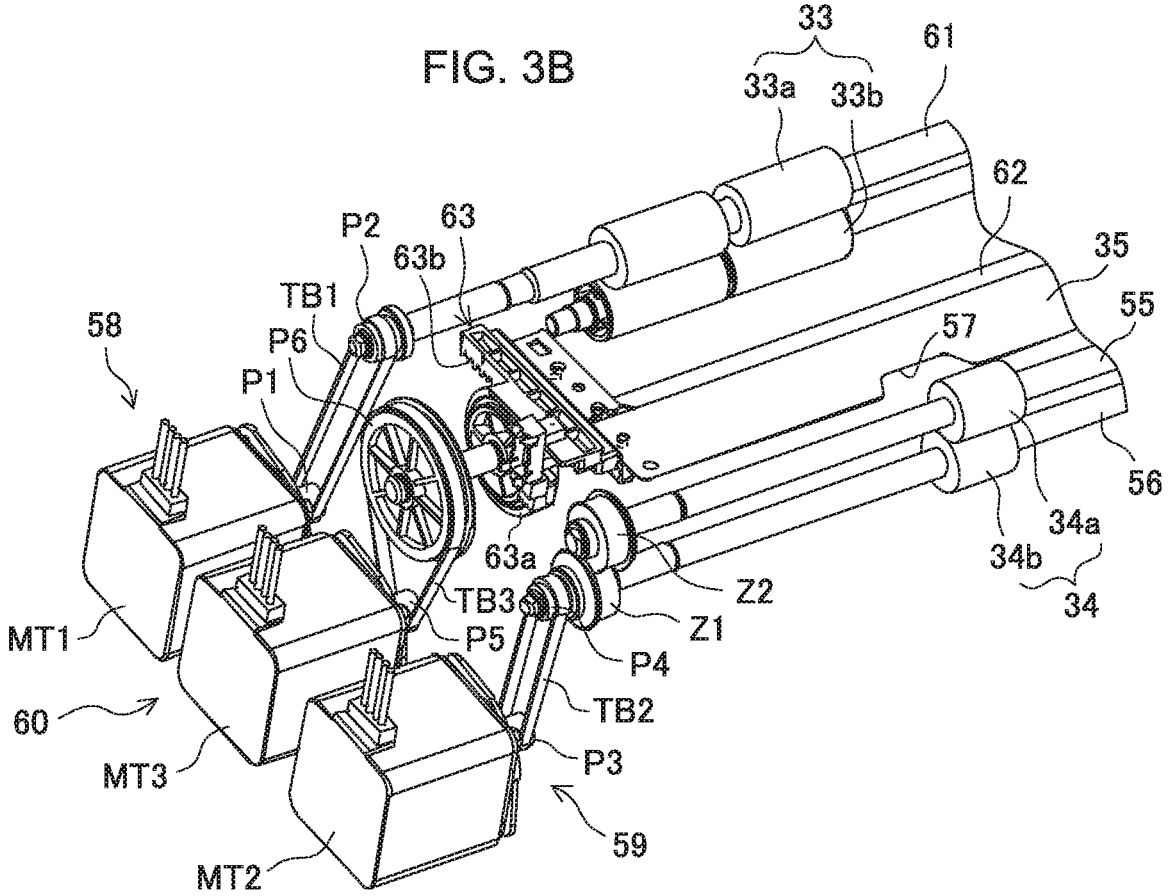
FIG. 3B is an enlarged schematic perspective view of a principal part of the drive mechanism.

FIGS. 3A and 3B show the configuration of the push plate 35 in greater detail. As shown in FIGS. 3A and 3B, a total of four folding roller pairs 34, each having an upper folding roller 34*a* and a lower folding roller 34*b*, are fitted to the upper and lower roller shafts 55, 56. The four pairs are arranged along the axial direction of the roller shafts 55, 56 symmetrically relative to the center position of the roller shafts 55, 56. In other words, two pairs are arranged on the right side and the remaining two pairs are arranged on the left side along the roller shafts 55, 56. The push plate 35 is provided at its front end with four notches 57 at positions that correspond to the respective positions of the four folding roller pairs 34. At the front end of the push plate 35, the notches 57 are arranged in the width direction of the sheet to be folded by the folding roller pairs 34 so as to correspond to the respective positions of the four folding roller pairs 34 and have a profile and dimensions that match the profile and the dimensions of the four folding roller pairs 34.

The push plate 35 is driven to move to and from the retreat position, the guide position and the push position by driving the push motor MT3 of the drive mechanism shown in FIG. 5, which drive mechanism will be described in greater detail below. The operation of driving the push motor MT3 is controlled by the control section 120 shown in FIG. 5, which control section 120 will also be described in greater detail hereinafter.

[Drive Mechanisms of Sheet Folding Apparatus]

FIGS. 3A and 3B schematically illustrate the drive mechanisms 58 to 60 of the registration roller pair 33, the folding roller pair 34 and the push plate 35 of the sheet folding apparatus C. The drive roller 33*a* of the registration roller pair 33 is fitted to the roller shaft 61 so as to integrally rotate with the roller shaft 61, which is installed so as to be rotatable in the width direction of the sheet to be folded. The upper and lower folding rollers 34*a*, 34*b* of the folding roller pair 34 are respectively fitted to the roller shafts 55, 56 so as to integrally rotate with the roller shafts 55, 56, which are also installed so as to be rotatable in the width direction of the sheet to be folded.

The drive mechanism 58 of the registration roller pair 33 includes a conveyance motor MT1, a drive pulley P1 fitted to the rotary shaft of the conveyance motor MT1, a follower pulley P2 fitted to one of the opposite ends of the roller shaft 61 of the drive roller 33*a* and a timing belt TB1 that is looped between the two pulleys P1, P2. The drive power of the conveyance motor MT1 is transmitted from its rotary shaft to the drive roller 33*a* by way of the transmission mechanism that includes the drive pulley P1, the timing belt TB1 and the follower pulley P2.

The drive mechanism 59 of the folding roller 11 includes a folding motor MT2, a drive pulley P3 fitted to the rotary shaft of the folding motor MT2, a follower pulley P4 fitted to the roller shaft 56 of the lower folding roller 34*b* and a timing belt TB2 that is looped between the two pulleys P3, P4. Additionally, the drive mechanism 59 also includes a gear Z1 that is coaxially fitted to the roller shaft 56 so as to be integrally rotatable with the roller shaft 56 and another gear Z2 that is coaxially fitted to the roller shaft 55 of the of the upper folding roller 34*a* so as to be integrally rotatable with the roller shaft 55.

The drive power of the folding motor MT2 is transmitted from its rotary shaft to the lower folding roller 34*b* by way of the transmission mechanism that includes the drive pulley P3, the timing belt TB2 and the follower pulley P4. Additionally, the drive power of the folding motor MT2 is also transmitted from the roller shaft 56, to which the follower pulley P4 is fitted, to the upper folding roller 34*a* by way of the gear Z1 and the gear Z2 that are engaged with each other. As a result, the upper folding roller 34*a* and the lower folding roller 34*b* rotate in opposite directions in synchronism with each other and can cooperate to convey the sheet that is nipped between the two folding rollers in the sheet conveyance direction.

The drive mechanism 60 of the push plate 35 includes a push motor MT3, a drive pulley P5 fitted to the rotary shaft of the push motor MT3, a rotary shaft 62 installed to extend in the width direction of the sheet to be folded, a follower pulley P6 fitted to one of the opposite ends of the rotary shaft 62, a timing belt TB3 looped between the two pulleys P5, P6, a first rack-and-pinion mechanism 63 arranged on the side of the above identified end of the rotary shaft 62 and inside relative to the follower pulley P6 and a second rack-and-pinion mechanism 64 arranged at the other end of the rotary shaft 62.

The first rack-and-pinion mechanism 63 in turn includes a first pinion 63*a* coaxially fitted to the rotary shaft 62 so as to be integrally rotatable with the rotary shaft 62 on the side of the above-identified end and inside relative to the follower pulley P6 and a first rack 63*b* fitted to one of the opposite ends of the push plate 35 and engaged with the first pinion 63*a*. Similarly, the second rack-and-pinion mechanism 64 includes a second pinion 64*a* coaxially fitted to the rotary shaft 62 so as to be integrally rotatable with the rotary shaft 62 on the side of the above identified other end of the rotary shaft 62 and a second rack 64*b* fitted to the other end of the push plate 35 and engaged with the second pinion 64*a*. The first and second racks 63*b*, 64*b* are provided such that the push plate 35 can be moved in horizontal directions by the rotatory motions of the first and second pinions 63*a*, 64*a*.

The drive power of the push motor MT3 is transmitted from its rotary shaft to the first and second pinions 63*a*, 64*a* by way of the transmission mechanism that includes the drive pulley P5, the timing belt TB3 and the follower pulley P6. As a result, the first and second racks 63*b*, 64*b* are moved synchronously in the same direction so as to cooperate with each other to move the push plate 35 in horizontal directions.

[Control System of Sheet Folding Apparatus]

Figure 5:
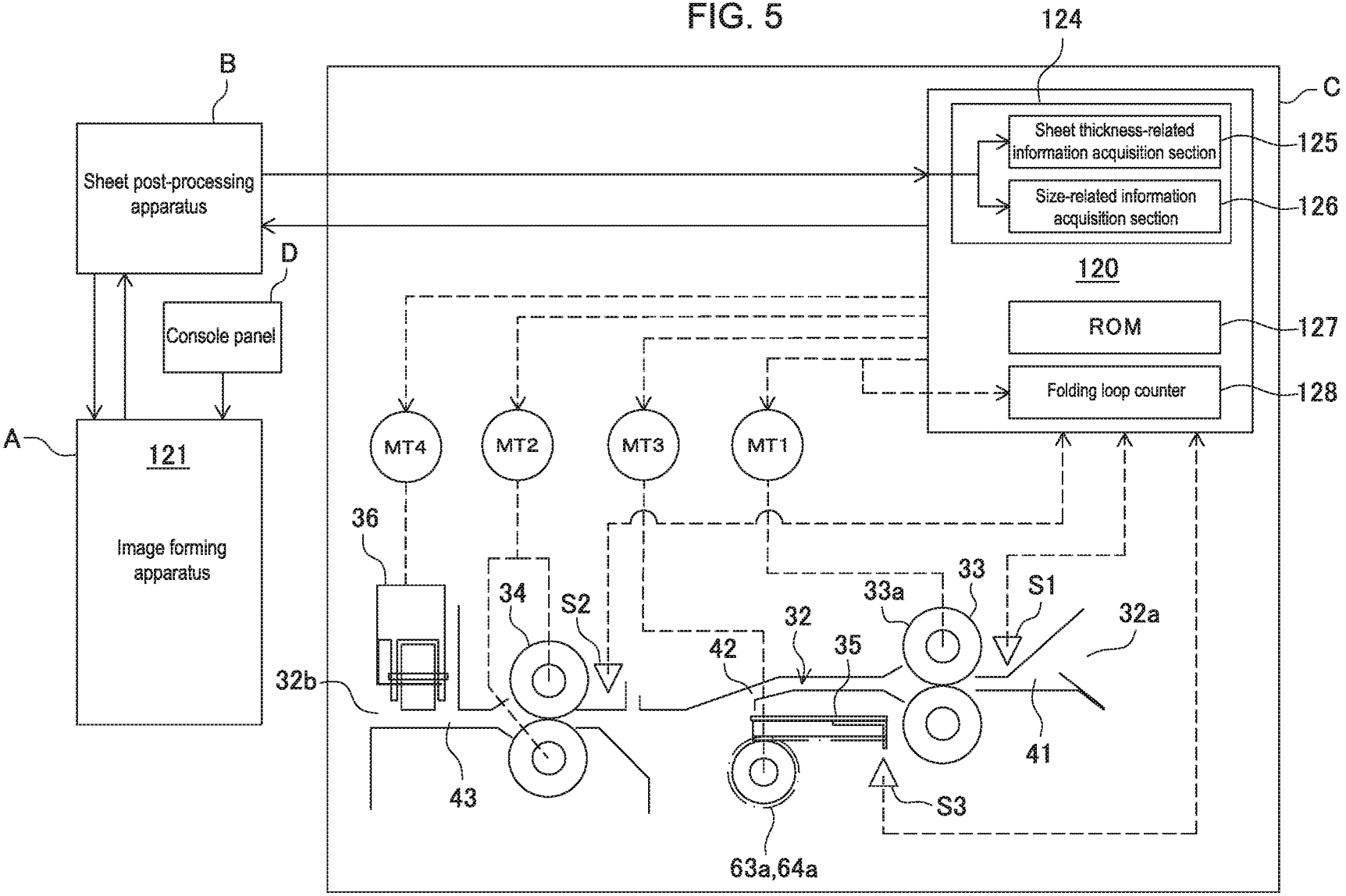
FIG. 5 is a block diagram of the control system of sheet folding apparatus.

FIG. 5 is a schematic conceptual illustration of the control system of the sheet folding apparatus C. The sheet folding apparatus C comprises a control section 120 that includes a control board having a CPU. As shown in FIG. 5, first through third detection sensors S1 to S3 are arranged along the conveyance route 32 and connected to the control section 120.

The first detection sensor S1 is arranged in front of the registration roller pair 33 on the sheet carry-in path 41 to detect the leading edge of the sheet that is carried in from the image forming apparatus A by way of the sheet carry-in port 32*a*. The second detection sensor S2 is arranged in front of the sheet folding roller pair 34 on the conveyance path 42 to detect the leading edge of the sheet being conveyed from the registration roller pair 33 to the folding roller pair 34. The third detection sensor S3 is arranged to detect the position of the push plate that is driven to move to and from the retreat position, the guide position and the push position. The results of detection obtained by the first through third detection sensors S1 to S3 are output to the control section 120 on a real time basis.

Furthermore, the control section 120 is connected to the control section 121 of the image forming apparatus A by way of the sheet post-processing apparatus B. The control section 121 is connected to the input section and the display section (not shown) arranged on the settings panel D of the image forming apparatus A. For instance, the type of sheet that the user of the apparatus selects on the settings panel D and information on the mode of the folding process and so on to be executed in the sheet folding apparatus C are transmitted from the control section 121 to the control section 120 by way of the sheet post-processing apparatus B.

The control section 120 comprises a folding process-related information acquisition section 124 for acquiring and storing the information transmitted from the control section 121 of the image forming apparatus A. The folding process-related information acquisition section 124 includes a sheet thickness-related information acquisition section 125 for acquiring and storing thickness-related information on the sheet or sheets to be subjected to a folding process and size-related information acquisition section 126 for acquiring and storing size-related information also on the sheet or sheets to be subjected to a folding process.

The control section 120 is connected to the conveyance motor MT1, to the folding motor MT2, to the push motor MT3 and, if an additional folding mechanism 36 is provided, also to the additional folding drive motor MT4 of the additional folding mechanism 36. The control section 120 controls the operations of driving the drive motors MT1 through MT3 and, if necessary, MT4 according to the detection results of the first through third detection sensors S1 through S3 and the various pieces of information it receives from the control section 121 of the image forming apparatus A and also controls the sheet conveying operation on the conveyance route 32 and the execution of the sheet folding process in the sheet folding apparatus C. Note that, in this embodiment, both the conveyance motor MT1 and the folding motor MT2 are controlled so as to be driven to rotate either in the first drive speed (high speed) Va mode in which the registration roller pair 33 and the folding roller pair 34 are driven to convey a sheet at the first conveyance speed V1 or in the second drive speed (low speed) Vb mode in which the registration roller pair 33 and the folding roller pair 34 are driven to rotate to convey a sheet at the second conveyance speed V2 that is slower than the first conveyance speed V1. Additionally, the push motor MT3 is also controlled so as to be driven to rotate either in the first moving speed mode in which the push plate 35 is moved at the first moving speed V1, which is equal to the first conveyance speed V1, or in the second moving speed mode in which the push plate 35 is moved at the second moving speed V2, which is equal to the second conveyance speed V2.

Furthermore, the control section 120 can transmit information on the sheet conveyance operation, the sheet folding operation and other operations, if any, that are being executed in the sheet folding apparatus C to the control section 121 of the image forming apparatus A by way of the sheet post-processing apparatus B on a real time basis. If the information received from the control section 120 includes unfavorable information, information that requires attention and/or warning and tells that the sheet conveyance operation and/or the sheet folding operation in the sheet folding apparatus C involves one or more failures, the control section 121 can notify the user of the information by means of, for example, the display section of the settings panel D.

The control section 120 has a ROM 127 for storing the control programs for various control operations to be executed by the control section 120 including those that are described above and those that will be described hereinafter and data necessary for the executions of such control operations. Additionally, the control section 120 contains a folding loop counter 128, which will be described in greater detail hereinafter.

Figures 6A, 6B:
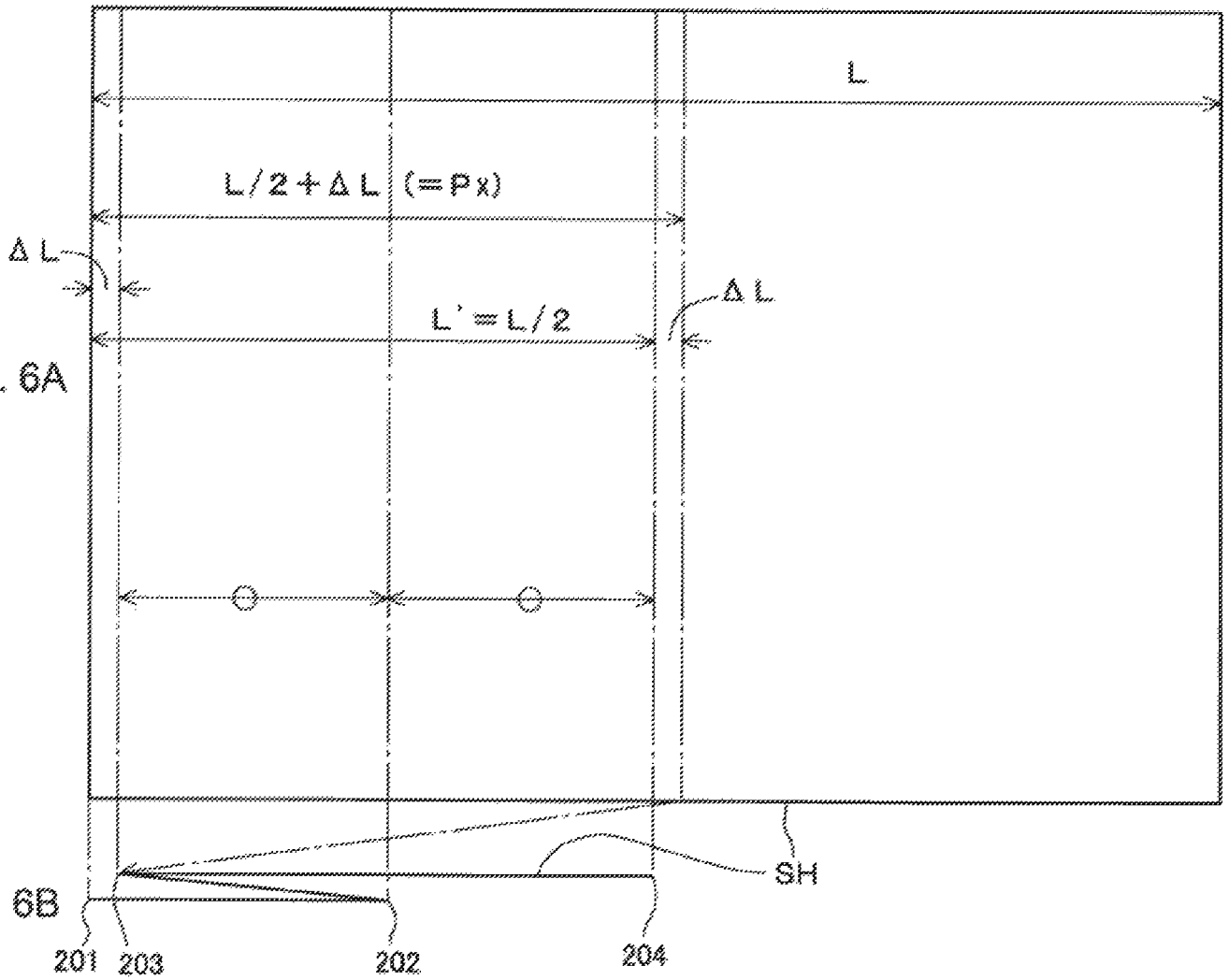
FIG. 6A is a schematic plan view of a sheet in a state prior to being subjected to a folding process and FIG. 6B is an end view of the sheet after being folded into three parts for Z-fold.

The sheet folding apparatus C of this embodiment is suited to produce Z-fold by inwardly folding a sheet and subsequently outwardly folding the sheet along the sheet conveyance direction to fold the sheet into three parts. FIG. 6A shows a plan view of a sheet SH before it is subjected to a folding process and FIG. 6B shows a lateral view of the sheet SH folded by the sheet folding apparatus C to produce Z-fold as viewed in the width direction of the sheet. Referring to FIG. 6B, the first fold 202 is formed on the sheet SH at a position separated from the front end (downstream side end) 201 thereof as viewed in the sheet conveyance direction by a predetermined length toward the upstream side and then the second fold 203 is formed on the sheet by folding back the sheet on the downstream side at a position separated from the first fold by a predetermined distance.

Referring to FIGS. 6A and 6B, the leading edges of the sheets SH to be folded are aligned in the sheet conveyance direction. As seen from FIGS. 6A and 6B, in this embodiment, the sheet SH is so folded to produce Z-fold such that the length of the sheet as viewed in the sheet conveyance direction is ½ of the original length of the sheet. Now, the sheet folding processing operation of the sheet folding apparatus C will be described below.

[Processing Operation of Sheet Folding Apparatus]

A folding processing mode (for Z-fold) in which the sheet folding apparatus C executes a folding process for folding a sheet into three parts (and producing Z-fold) and a fold-free mode in which the sheet is not subjected to any folding process are preset in the sheet folding apparatus C. Prior to starting an image forming operation by the image forming apparatus A, the user determines if a sheet folding process is to be executed or not on the sheet after forming an image thereon and, if a sheet folding process is to be executed, the user selects and inputs the folding processing mode to the input section of the settings panel D. The selected and input folding processing mode is stored in the control section 121 of the image forming apparatus A as a piece of information on the sheet to be subjected to a sheet folding process.

Figure 8:
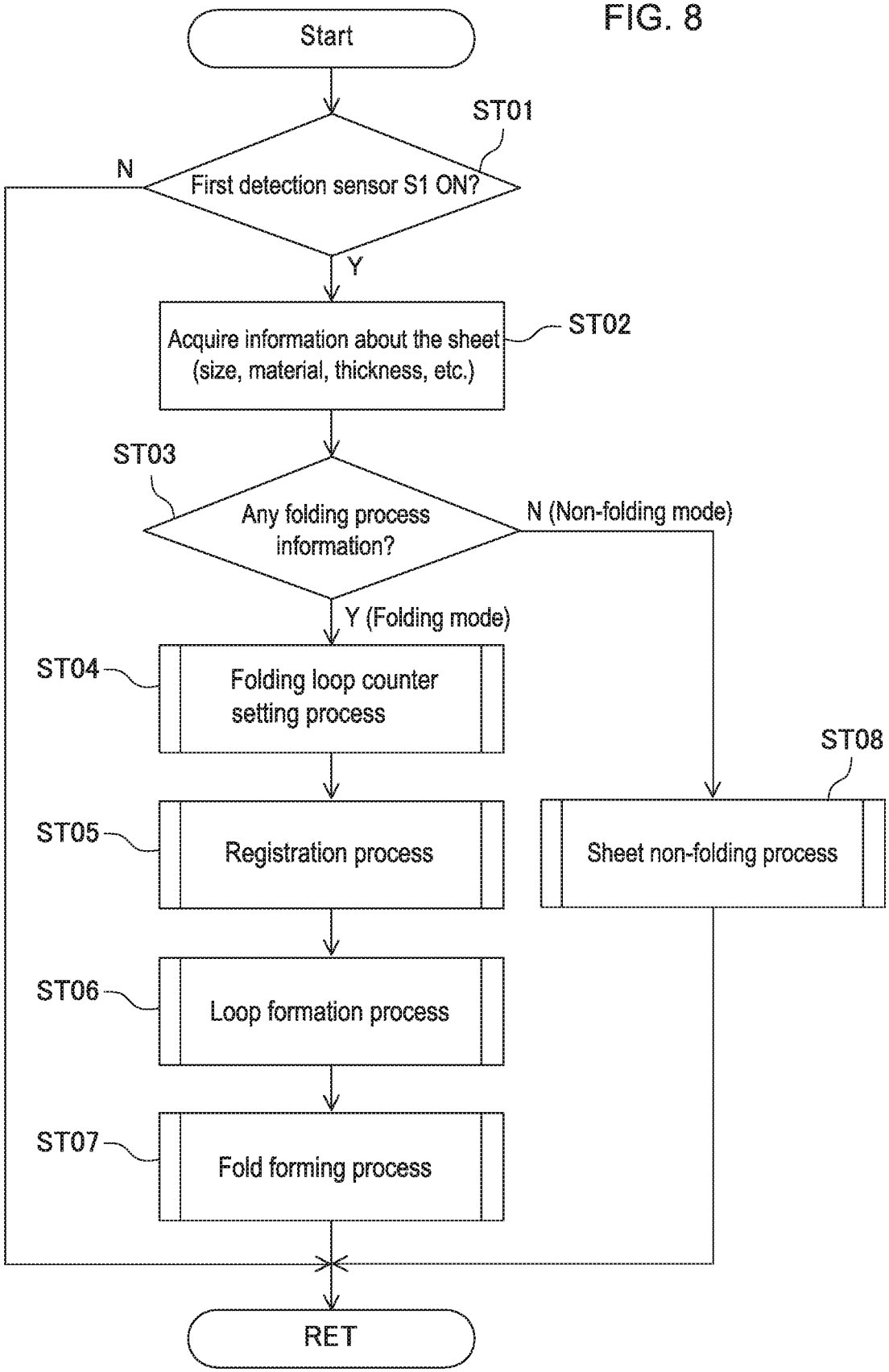
FIG. 8 is a flowchart of the entire processing operation of the sheet folding apparatus.

Now, the entire processing operation of the sheet folding apparatus C will summarily be described below by referring to the flowchart of FIG. 8. In the control section 120 of the sheet folding apparatus C, firstly as the first detection sensor S1 detects the leading edge of the sheet carried in the sheet carry-in path 41 and becomes turned on (Y in Step S101), the control section is triggered by the detection and the on-action of the first detection sensor S1 to acquire the sheet information on the detected sheet from the control section 121 of the image forming apparatus A by way of the sheet post-processing apparatus B (Step ST02). The sheet information includes the size, the material, the thickness (and the weight) of the sheet, information relating to the characteristics of the sheet itself such as the direction in which the sheet is being conveyed (either in the longitudinal direction or in the transversal direction), information relating to the folding process to be executed from now on and information relating to the post-processing operations such as the binding process to be executed by the sheet post-processing apparatus B after passing through the sheet folding apparatus C.

In this embodiment, the sheet folding apparatus acquires information on the measured weight of the sheet to be subjected to a folding process from the sheet information sent from the control section 121 of the image forming apparatus A. In a different embodiment, the sheet folding apparatus C can acquire by itself the weight of the sheet being carried in from the image forming apparatus A. For example, there is a known detection technique of emitting a sound wave of a predetermined frequency to the surface of the sheet that is being carried in and computationally determining the weight of the sheet from the intensity of the sound wave that has passed through the sheet. When the sheet folding apparatus C is provided with a detection mechanism that employs such a detection technique, the sheet folding apparatus C can immediately accommodate a sheet of a type that is not expected to be processed by the sheet folding apparatus C.

When the sheet information acquired from the control section 121 of the image forming apparatus A contains the selection of the folding processing mode or the instruction for execution of a folding process (Y in Step ST03), the control section 120 proceeds to Steps ST04 through ST07 and executes the folding process. When the sheet information from the control section 121 of the image forming apparatus A does not contain any selection of the folding process mode and hence any instruction for execution of a folding process, the control section 120 proceeds to Step ST08 and executes a fold-free process.

In the fold-free process in Step ST08, the push plate 35 is arranged at the guide position (35') and the registration roller pair 33 and the folding roller pair 34 are driven to rotate in this state. Then, as a result, the sheet carried in from the image forming apparatus A is allowed to pass through the conveyance route 32 without being subjected to any folding process and carried out to the sheet post-processing apparatus B.

The folding process that includes Steps ST04 through ST07 is executed in four stages of a folding loop counter setting process (Step ST04) to be executed by the control section 120, a registration process (Step ST05) to be executed by the registration roller pair 33, a looping and folding process to be executed by the folding roller pair 34 (Step ST06) and a fold forming process (Step ST07) to be executed by the push plate 35 and the folding roller pair 34. A value is set on the folding loop counter in the folding loop counter setting process. The leading edge of the sheet that is carried in into the sheet folding apparatus C is placed at the right position and the sheet skew, if any, is corrected in the registration process. A loop for forming a fold is formed on the front end side of the sheet in the looping for folding process. A fold is formed on the sheet on which a loop has been formed by the folding roller pair 34 in the fold forming process.

The processes that are executed respectively in Step ST04 through ST07 will now be described more specifically by referring to FIGS. 9 through 12. FIGS. 7A through 7F schematically illustrate the sequence of operations from the operation by the sheet folding apparatus C of carrying in a sheet from the image forming apparatus A down to the operation of executing a folding process on the sheet that is being conveyed on a step by step basis. The above-described folding loop counter setting process is preferably executed at latest before a sheet is carried in from the image forming apparatus A to the sheet folding apparatus C and the registration process is started.

[Folding Loop Counter Setting Process]

Figure 9:
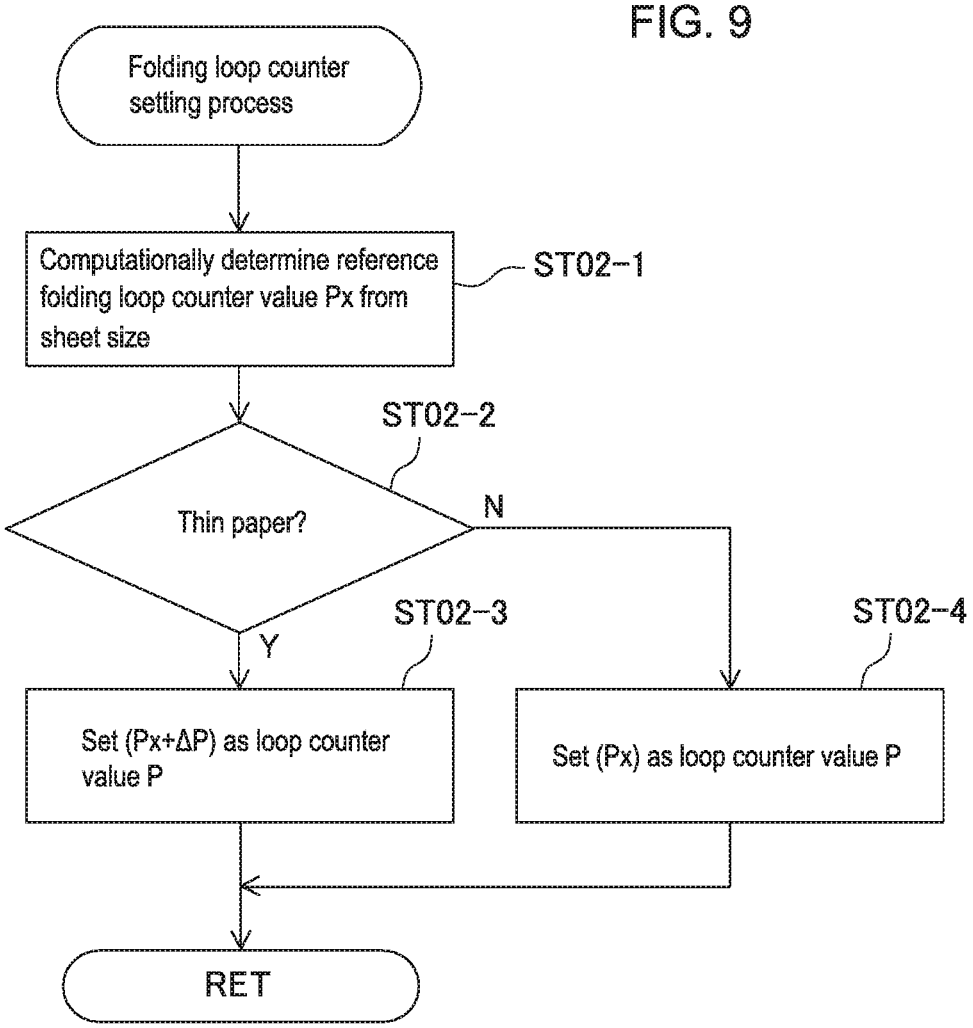
FIG. 9 is a flowchart of the folding loop counter setting process of the sheet folding apparatus.
Figure 10:
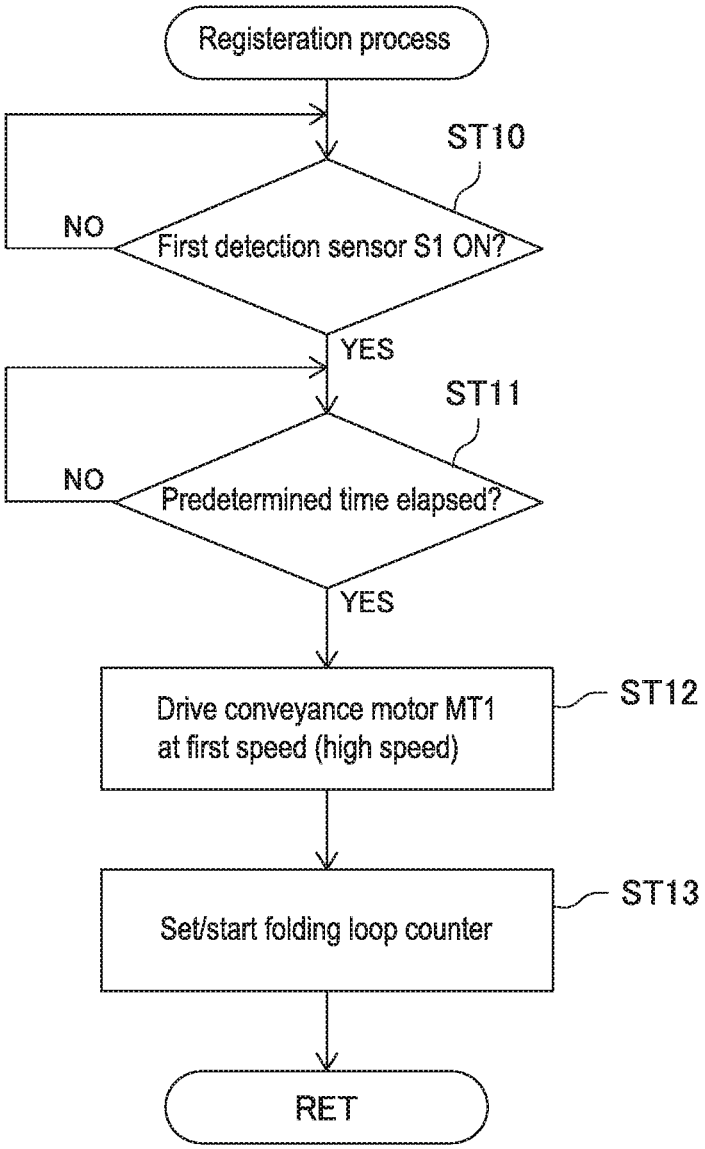
FIG. 10 is a flowchart of the registration process of the sheet folding apparatus.

The folding loop counter setting process is executed typically by following the sequence shown in the flowchart of FIG. 9. In the control section 120, the size information acquisition section 126 acquires information relating to the size of the sheet from the sheet information that the sheet information acquisition section 124 received from the control section 121 of the image forming apparatus A. Then, the control section 120 determines the reference folding loop counter value Px on the basis of the acquired sheet size (Step ST02-1).

The reference folding loop counter value Px is used to determine the timing of starting the operation of pushing the sheet by the push plate 35 as will be described in greater detail hereinafter. For example, the control section 120 can computationally determine the reference folding loop counter value Px by using one or more predetermined formulae. Alternatively, reference folding loop counter values Px may be predetermined respectively for the plurality of sheet sizes that are expected to be used in the image forming apparatus A and stored in the ROM 127 so that the control section 120 can be made to select the reference folding loop counter value Px that corresponds to the sheet size that the size information acquisition section 126 has acquired.

Next, the thickness information acquisition section 125 acquires information relating to the thickness of the sheet from the sheet information acquired from the image forming apparatus A. Then, the control section 120 determines if the sheet that is to be subjected to a sheet folding process is a thin sheet or not on the basis of the acquired thickness of the sheet (Step ST02-2).

When the control section 120 determines that the sheet is a thin sheet (Y in Step ST02-2), the control section 120 sets the value obtained by adding the predetermined misalignment value ΔP to the reference folding loop counter value Px on the folding loop counter 128 as folding loop counter value P (Step ST02-3). When, on the other hand, the control section 120 determines that the sheet is a thick sheet (N in Step ST02-2), the control section 120 sets the folding loop counter value Px in the folding loop counter 128 as folding loop counter value P (Step ST02-4).

The reference folding loop counter value Px is the standard timing for starting moving the push plate 35 that is applied to a thick sheet, whereas the misalignment value ΔP is the delay time to be added to the standard timing for starting moving the push plate 35. As will be described hereinafter, the misalignment value ΔP of the folding loop counter value can be preset as a function of the level of thickness of a thin sheet, namely the level of thinness of a thin sheet, relative to the thickness of a thick sheet or that of a standard sheet.

As far as this embodiment is concerned, sheets of commercially available copy paper that is referred to as ordinary paper and sheets having a thickness greater than the thickness of sheets of ordinary paper are defined as thick sheets and sheets having a thickness smaller than the sheets of ordinary paper are defined as thin sheets. The above-described folding loop counter setting process is based on the above-described definitions. In a different embodiment, sheets having a thickness greater than the thickness of sheets of ordinary paper may be referred to as thick sheets and sheets having a thickness smaller than the thickness of sheets of ordinary paper may be referred to as thin sheets. Alternatively, sheets may be classified into three thickness categories including the thickness of ordinary paper, the thickness greater than that of ordinary paper, and the thickness smaller than that of ordinary paper.

In actual situations, the control section 120 can be made to recognize the thickness of the sheet carried into the sheet folding apparatus C according to the type of the sheet that the user selected on the settings panel D of the image forming apparatus A. Since the types of sheets that are expected to be used in the image forming apparatus A and the thicknesses of those sheets are known in advance, it is only necessary to define the thickness categories of those types of sheet in advance.

[Registration Process]

FIG. 7A shows a state where the leading edge of the sheet carried into the sheet folding apparatus C is placed at the right position in the registration process. The registration process is executed typically by following the sequence illustrated in the flowchart of FIG. 9.

As the first detection sensor S1 detects the leading edge of the sheet carried onto the sheet carry-in path 41 and becomes turned on in a state where the rotatory motion of the registration roller pair 33 is suspended (Y in Step ST10), the control section 120 measure the time elapsed from that time point. When the elapsed time becomes equal to the predetermined time (Y in Step ST11), the control section 120 drives the conveyance motor MT1 (Step ST12) to rotate the registration roller pair 33. At this time, the conveyance motor MT1 is driven to rotate at the first drive speed (high speed) Va so as to make the registration roller pair 33 send out the sheet at the preset first conveyance speed V1.

The predetermined time in Step ST11 is the period of time required to allow the leading edge of the sheet to contact the nip section 38 of the registration roller pair 33 and also allow the sheet to become warped to form a loop having a size that is necessary and sufficient to place the leading edge of the sheet at the right position on the sheet carry-in path 41. This period of time can be determined in advance on the results of a series of tests conducted for this purpose and preset in the control section 120.

As the registration roller pair 33 is driven to rotate, the sheet is conveyed along the conveyance path 42 to the folding roller pair 34 as shown in FIG. 7B. The start of driving the conveyance motor MT1 in Step ST12 is made to trigger a counting operation of the folding loop counter 128 of the control section 120 (Step ST13).

When the sheet SH is sent out from the registration roller pair 33, the push plate 35 is placed at the guide position 35'. Therefore, the leading edge of the sheet is guided along the conveyance path 42 by the upper surface of the push plate 35 and sent straight toward the nip section 39 of the folding roller pair 34. As the leading edge of the sheet passes by the protruded portion 47 of the conveyance path 42, the sheet is pushed downward by the protruded portion 47 and warped to project into the loop forming space 50 in the region where the inclined part 45*c* and the second horizontal part 45*b* of the upper conveyance guide 45 are connected in the sheet conveyance direction to each other in front of the gap 48.

[Looping for Folding Process]

Figure 11:
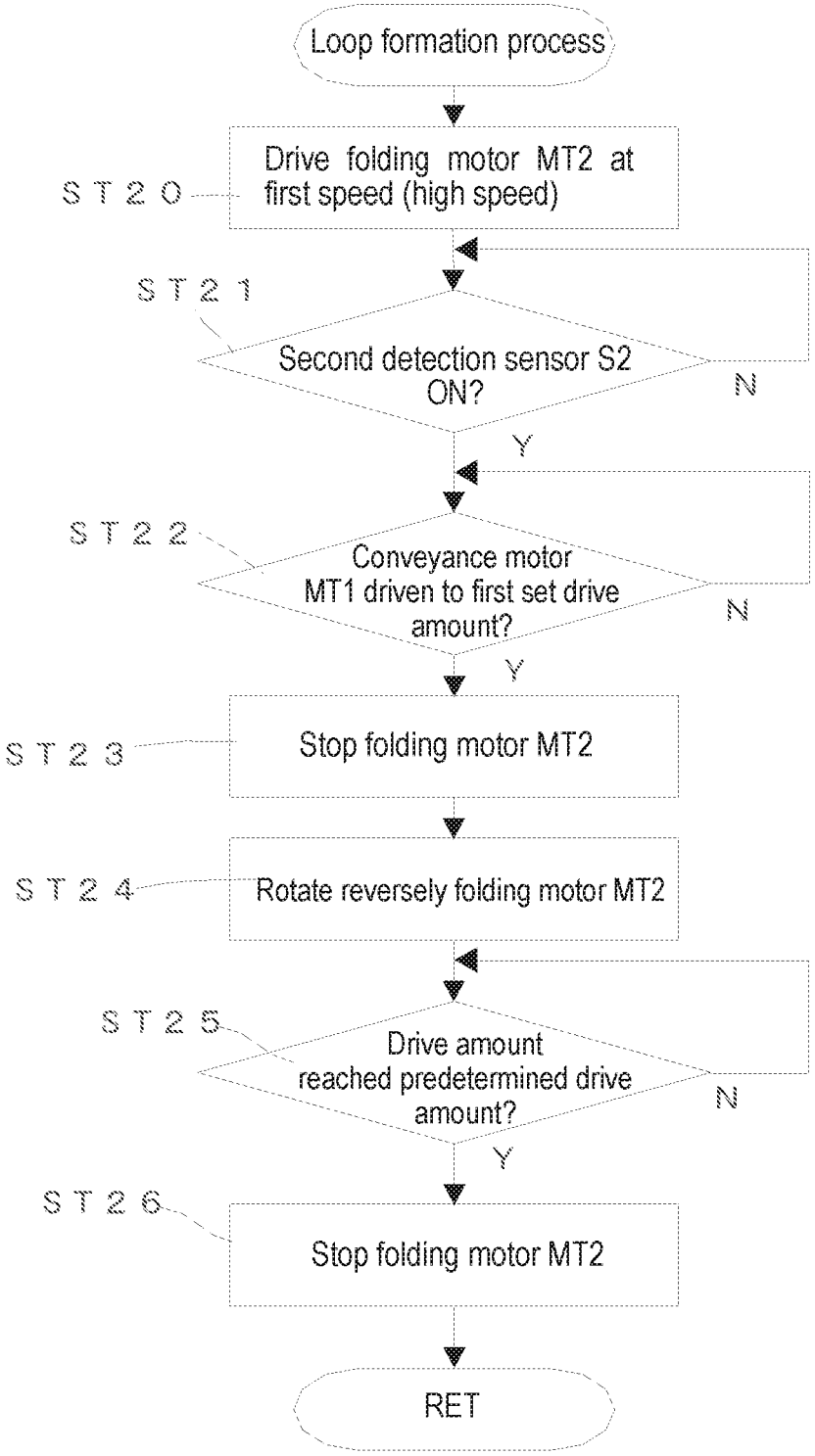
FIG. 11 is a flowchart of the loop formation process of the sheet folding apparatus.

The looping for folding process is executed by following the sequence illustrated in the flowchart of FIG. 11. The control section 120 starts driving the conveyance motor MT1 and, at the same time, starts driving the folding motor MT2 to forwardly rotate at the first drive speed (high speed) Va in Step ST12. Then, as a result, the folding motor MT2 drives the folding roller pair 34 to rotate so as to make the sheet conveying speed equal to the first conveyance speed V1, which is the same as the rotational speed of the registration roller pair 33 (Step ST20). As shown in FIG. 7B, when the second detection sensor S2 detects the leading edge of the sheet on the immediately upstream side of the folding roller pair 34 and becomes turned on (Y in Step ST21), the looping for folding process proceeds to Step ST22.

As the second detection sensor S2 detects the leading edge of the sheet in Step ST21, at the same time and in parallel with this operation, the control section 120 executes a retreat process of moving the push plate 35 from the guide position to the retreat position on a multitask basis. As the push plate 35 is moved to the retreat position, the second route section of the conveyance path 42 is opened to the loop forming space 50 located below it. The retreat process of the push plate 35 will be described hereinafter by referring to FIG. 14.

In Step ST22, the control section 120 determines if the drive amount, which may typically be the number of rotations, of the conveyance motor MT1 has reached the first set drive amount K1 that has been preset or not from the time when the second detection sensor S2 detected the leading edge of the sheet (and became turned on) in Step ST21. When the drive amount has reached the first set drive amount K1 (Y in Step ST22), the control section 120 stops the folding motor MT2 (Step ST23). Note that the first set drive amount K1 is the drive amount of the conveyance motor MT1 necessary for the leading edge of the sheet to get to the position where it is nipped by the nip section 39 of the folding roller pair 34.

After the stop of the folding motor MT2, the control section 120 drives the folding roller pair 34 to rotate reversely by a predetermined amount and then stops the folding roller pair 34 so as to make the leading edge of the sheet to be located at the nip section 39 by using its folding position control means 120*a* and also by controlling the operation of driving the folding motor MT2 (Steps ST24 through ST26). Note that the folding roller pair 34 is driven to rotate reversely to bring back the sheet at a speed lower than the rotational speed of the folding roller pair 34 when it receives the sheet. With this arrangement, the folded sheet is made to project only to a small extent (by a small tab size) from the second fold 203.

The counting operation of the folding loop counter is kept on during the operation of reversely conveying the sheet by the folding roller pair 34 and hence the operation of the registration roller pair 33 of conveying the sheet toward the folding roller pair 34 is also kept on. Thus, the registration roller pair 33 keeps on rotating and sending out the sheet even after the leading edge of the sheet is brought into a state where it is nipped by the nip section 39 of the folding roller pair 34 as shown in FIG. 7C. Then, as a result, the part of the sheet that is located on the upstream side relative to the folding roller pair 34 is allowed to hang down from the gap 48 and become curved to form a loop FL for forming a fold on the sheet in the loop forming space 50. Even thereafter, the loop FL is made to grow as a function of the amount by which the sheet is sent out from the registration roller pair 33.

Note that a pulse motor is adopted for the conveyance motor MT1 in this embodiment and the folding loop counter 128 counts the number of drive pulses of the conveyance motor MT1 and detects the amount by which the sheet has been sent out. Similarly, pulse motors are adopted respectively for the folding motor MT2 and the push motor MT3 and the operations of driving these motors, the rotatory motion of (the amount by which the sheet is sent out by) the folding roller pair 34 and the move of the push plate 35 can also be controlled on the basis of the number of drive pulses of the conveyance motor MT1.

[Retreat Process]

Figure 14:
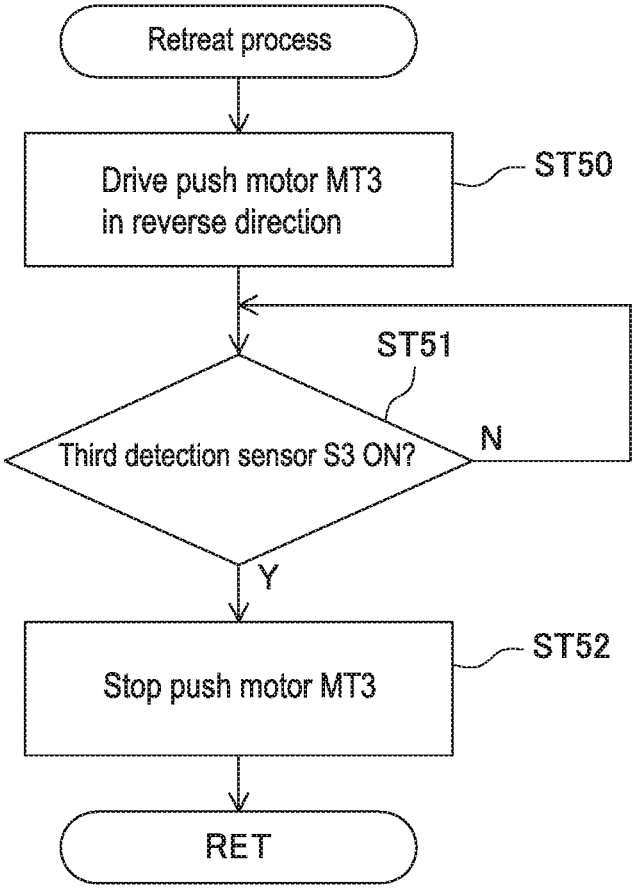
FIG. 14 is a flowchart of the retreat process of the push plate of the sheet folding apparatus.

The retreat process of the push plate 35 can be executed by following the sequence shown in the flowchart of FIG. 14 as described above. The control section 120 drives the push motor MT3 to rotate reversely (Step ST50) and moves the push plate 35 from the guide position 35' horizontally toward the upstream side as viewed in the sheet conveyance direction and also toward the retreat position. The push plate 35 of this embodiment is provided at the upstream side end thereof as viewed in the sheet conveyance direction with a detection flag (not shown).

When the third detection sensor S3 that is arranged below the first lower guide part 46*a* detects the detection flag of the push plate 35 and becomes turned on (Y in Step ST51), the push motor MT3 is stopped (Step ST52). Then, as a result, the push plate 35 is placed at the retreat position as shown in FIG. 7C and the gap between the first and second lower guide parts 46*a*, 46*b* is completely opened. Consequently, the second route section of the conveyance path 42 is opened for the loop forming space 50 located below it as shown in FIG. 7C.

In this embodiment, the sheet folding position is preset at the position that is defined, for example, by the distance from the leading edge of the sheet as viewed in the sheet conveyance direction depending on the size of the sheet and the direction (the longitudinal direction or the transversal direction) in which the sheet is conveyed. A predetermined counter value Px is preset in the folding loop counter for each sheet size and the position at which the sheet is to be folded in order to allow the sheet that is being conveyed to properly form a loop.

After the folding motor MT2 is stopped in Step ST23, when the folding loop counter 128 that has started counting in Step ST13 counts up to get to the predetermined count value, the fold forming process (Step ST06) and the push process of the push plate 35 are executed simultaneously in parallel as will be described below. Note that the folding loop counter 128 may be made to operate to count down from the predetermined count value down to "0".

[Push Process]

Figure 13:
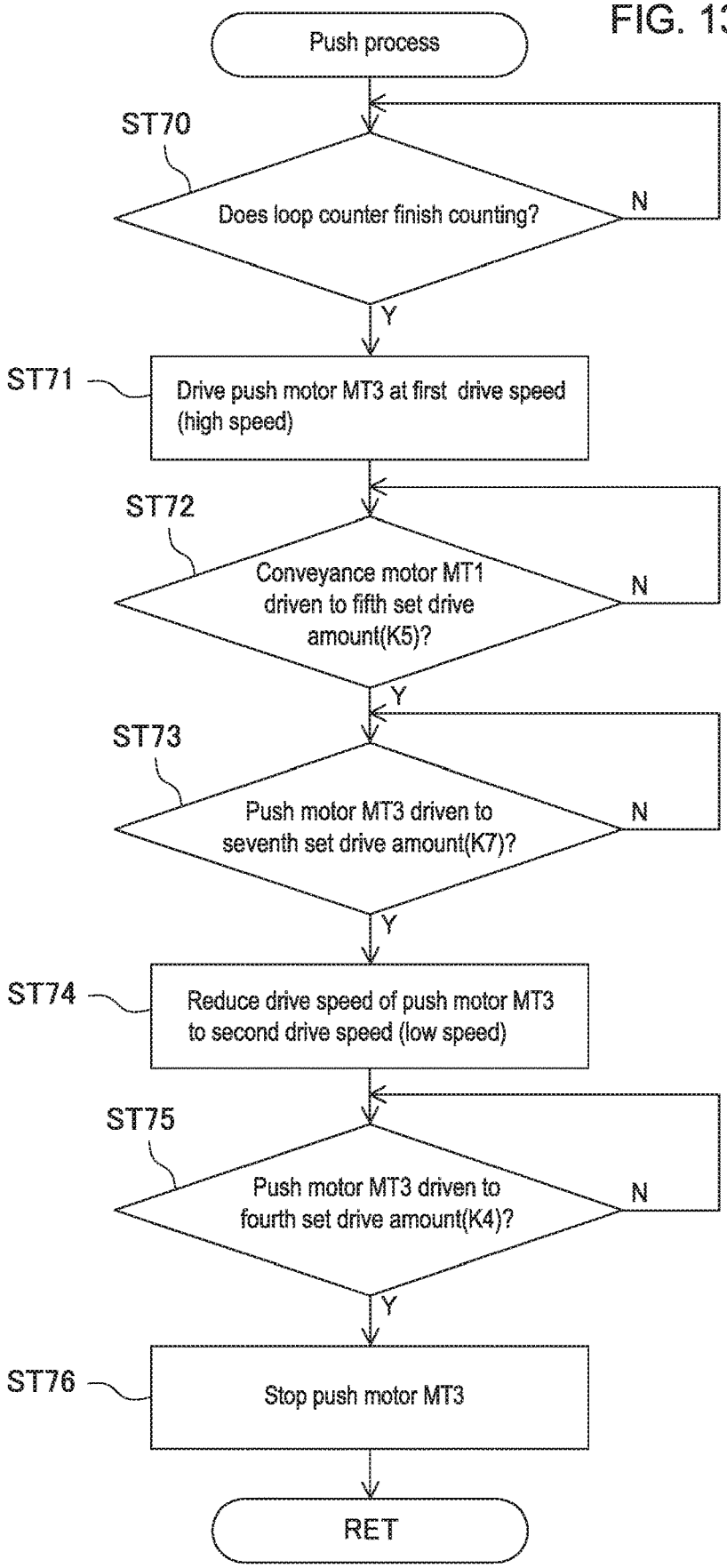
FIG. 13 is a flowchart of the push process of the push plate of the sheet folding apparatus.
Figure 16:
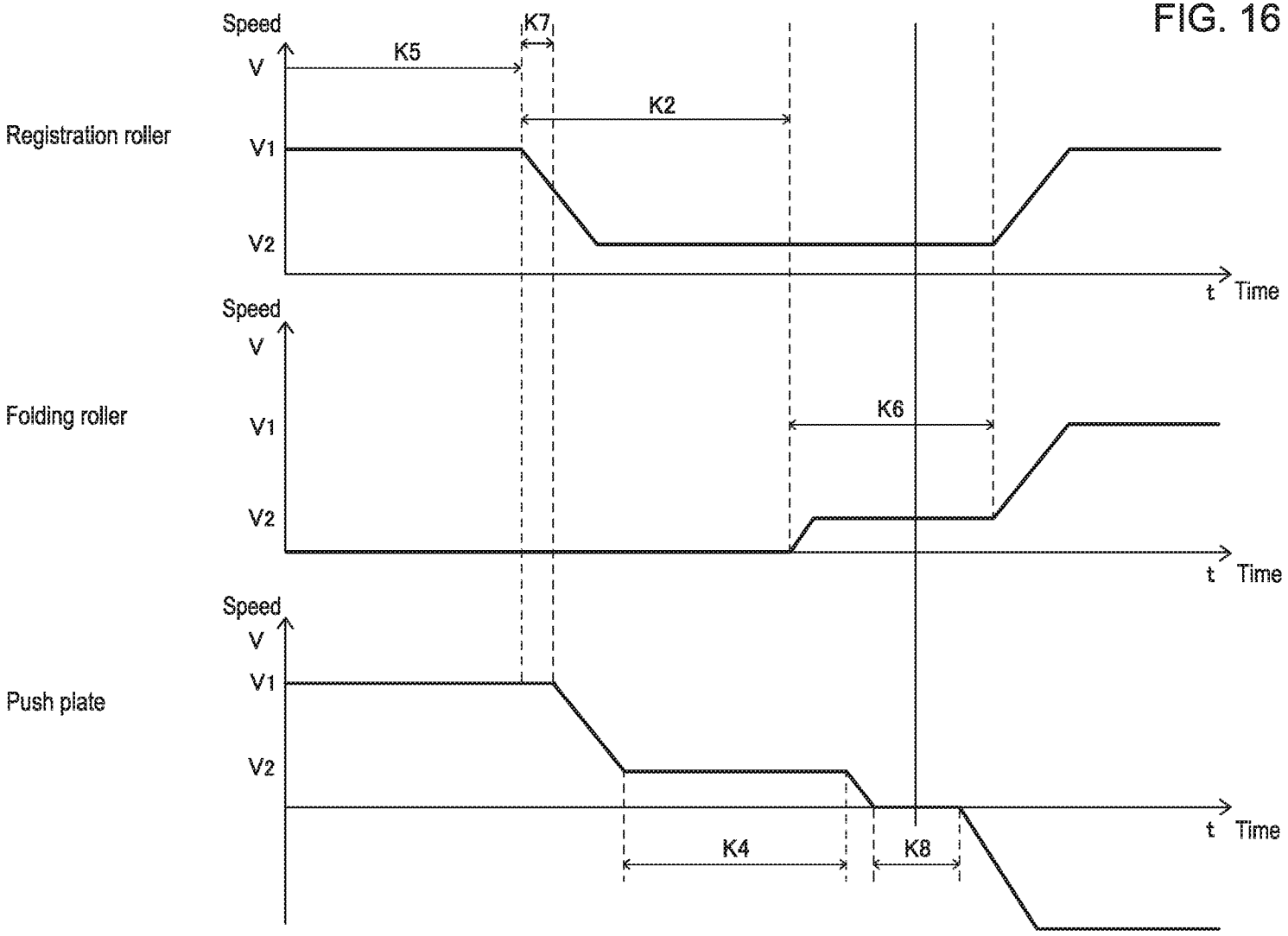
FIG. 16 is a timing chart of the concerted operation of the registration roller pair, the folding roller pair and the push plate.

The push process is executed by following the sequence shown in the flowchart of FIG. 13. Now, the push process will be described below by also referring to the timing chart shown in FIG. 16. FIG. 16 shows the change with time of the sheet conveying speed of the registration roller pair 33, that of the sheet conveying speed of the folding roller pair 34 and that of the moving speed (which is a positive value when moving in the sheet conveyance direction) of the push plate 35, all of which are controlled by the control section 12. In the graph of FIG. 16, the horizontal axis indicates time and the symbols K2 and K4 through K8 represent the numbers of drive pulses of the drive motors MT1 through MT3 that are counted in respective time intervals.

As the folding loop counter 128 counts up to the predetermined count value (Step ST70), the control section 120 drives the push motor MT3 to rotate in the forward direction at high speed (Step ST71) so as to horizontally move the push plate 35 at the first speed V1 toward the folding roller pair 34. At this time, the conveyance motor MT1 is kept on being driven and the sheet SH is being sent out to the conveyance path 42. The front end of the push plate 35 that has started to move from the retreat position toward the downstream side contacts the loop for folding FL at a position located close to the downstream side end of the first lower guide part 46*a* of the lower conveyance guide 46 from which the loop for folding starts hanging down.

The push plate 35 is moved further toward the nip section 39 of the folding roller pair 34, while pushing the sheet at a predetermined position thereof by means of the front end of the push plate 35. FIG. 16 illustrates in detail how the push plate 35 is moved on the second route section of the conveyance path 42 toward the downstream side. Referring to FIG. 16, the push plate 35 is moved linearly from the retreat position horizontally along the tangential line 39*a* of the nip section 39 as described above by referring to FIG. 4. The part of the sheet SH located on the upstream side from the front end of the push plate 35 is conveyed through the narrow gap between the second horizontal part 45*b* of the upper conveyance guide 45 and the upper surface of the push plate 35 during the time in which the push plate 35 passes below the second horizontal part 45*b* of the upper conveyance guide 45.

The control section 120 controls the sheet conveying speed of the registration roller pair 33 and that of the folding roller pair 34 by controlling the conveyance motor MT1 and the folding motor MT2. The control section 120 controls the moving speed of the push plate 35 by controlling the folding motor MT3. In this embodiment, the moving speed of the push plate 35 that starts moving from the retreat position is substantially controlled so as to be the same as the sheet conveying speed of the sheet that is sent out from the registration roller pair 33. As the sheet conveying speed and the moving speed of the push plate are controlled so as to be equal to each other in this way, the sheet SH is smoothly moved horizontally and linearly toward the downstream side in a state where the part of the sheet SH located on the upstream side from the front end of the push plate 35 is supported by the upper surface of the push plate 35 and the move of the sheet SH is substantially synchronized with the move of the push plate 35.

After the start of driving the push motor MT3, the drive amount of the push motor MT1 is counted from the time point when the drive amount of the conveyance motor MT1 gets to the preset fifth set drive amount (K5) (Y in Step ST72). In other words, the operation of counting the drive amount of the push motor MT3 is triggered by the time point when the drive amount of the conveyance motor MT1 gets to the preset fifth set drive amount (K5). As the drive amount of the push motor MT3 gets to the seventh set drive amount (K7) (Y in Step ST73), the push motor MT3 is controlled so as to rotate at low speed and hence the moving speed of the push plate 35 is reduced from the first moving speed V1 to the second moving speed V2 (Step ST74). Then, in Step ST30 and Step ST31 of the fold forming process shown in FIG. 12, which will be described in greater detail hereinafter, as the drive amount of the conveyance motor MT1 gets to the fifth set drive amount (K5) that is preset in advance, the sheet conveying speed of the registration roller pair 33 is reduced from the first conveyance speed V1 to the second conveyance speed V2 that is lower than the first conveyance speed. Thus, the moving speed of the push plate 35 is reduced after the sheet conveying speed of the registration roller pair 33 is reduced.

As the moving speed of the push plate 35 is reduced to the second moving speed V2, the operation of counting the drive amount of the push motor MT3 is started and, when the drive amount of the push motor MT3 gets to the fourth set drive amount (K4) (Y in Step ST75), the operation of driving the push motor MT3 is stopped (Step ST76). Then, as a result, the front end (downstream side end as viewed in the sheet conveyance direction) of the push plate 35 proceeds into between the second horizontal part 45*b* of the upper conveyance guide 45 and the second horizontal guide section 52*a* of the second lower guide part 45*b* and the push plate 35 is stopped. Note that the fourth set drive amount K4 is the drive amount of the push motor MT3 from the time when the moving speed of the push plate 35 is reduced to the second moving speed V2 to the time when the push plate 35 is braked to stop at the above-described push position. The amount of rotatory motion (the number of rotations of the rotary shaft, the angle of rotation of the rotary shaft, the time of rotatory motion or the like) of the push motor MT3 may be employed as the drive amount of the push motor MT3.

As the sheet that is pushed by the push plate 35 to move toward the downstream side on the conveyance path 42 proceeds from the second route section where its lower part is opened to the loop forming space 50 and gets into the third route section as shown in FIG. 16, the sheet is held in contact with and proceeds between the second horizontal part 45*b* of the upper conveyance guide 45 and the second lower guide part 46*b* of the lower conveyance guide 46 with the push plate 35 interposed between the sheet and the lower conveyance guide 46. Thus, the movement of the sheet is restricted both from above and from below and the resistance against the movement of the sheet increases. This situation can abruptly increase the load on the push motor MT3 and a step-out of the push motor MT3 can take place.

In view of the above identified risk, in this embodiment, a position located in front of the position at which the push plate 35 proceeds into between the second horizontal part 45*b* of the upper conveyance guide 45 and the second lower guide part 46*b* of the lower conveyance guide 46 is selected for the position at which the moving speed of the push plate 35 is reduced to the second moving speed V2. With this arrangement, the abrupt increase of the load on the push motor MT3 is suppressed to preliminarily prevent any step-out of the push motor MT3 from taking place.

In this embodiment, the timing of moving the push plate 35 from the retreat position shown in FIG. 7D toward the above-described push position is controlled and adjusted in order to dissolve the problem that the position of the fold can be shifted depending on the stiffness (the rigidity and the weight) of the sheet.

The amount of the shift of the position where a fold is to be formed of a sheet of thin paper relative to the amount of the corresponding shift of a sheet of ordinary paper and the amount of corresponding shift of thick paper that is satisfactorily acceptable from the viewpoint of achieving the above-described object of the present invention can be obtained by conducting a number of tests in advance and observing the actual shifts of each type of paper that is expected to be used and determining the average value of the actual shifts of each type of paper. The average value for the amount of positional shift of the fold forming position of a thin sheet that is obtained in the above-described manner is stored in the ROM 127 of the control section 120 and the expected amount of count shift ΔP of the folding loop counter is set in Steps ST02 and ST03 in the folding loop counter setting process described above by referring to FIG. 9.

Note that the reference folding loop counter value Px is the amount by which the sheet is fed out by the registration roller pair 33 after the registration process toward the downstream side as viewed in the conveyance direction. As shown in FIG. 6A, this value corresponds to the distance obtained by adding the length ΔL in the sheet conveyance direction from the (downstream side) leading edge of the sheet SH to the nip section of the folding roller pair 34 where the sheet SH is nipped and held in position (FIG. 7C) to L' which is a ½ of the length L of the sheet as viewed in the sheet conveyance direction.

As shown in FIG. 6B, the position expressed by the folding loop counter value Px corresponds to the second fold 203 of the sheet SH that is folded to produce Z-fold and is disposed at the rear side (the upstream side) relative to and separated by ΔL from the leading edge 201. An intermediate position between the position expressed by the folding loop counter value Px and the position that is disposed at the rear side relative to and separated by ΔL from the leading edge 201 corresponds to the first fold 202 of the sheet SH on which Z-fold is produced. Therefore, the rear side (upstream side) end 204 of the sheet SH, on which Z-fold is produced, corresponds to the position separated from the leading edge 201 by L', which is a ½ of the length L of the original sheet as viewed in the sheet conveyance direction. Thus, with this embodiment, the length of the sheet on which Z-fold is produced can be made to agree with a ½ of the length of the original sheet (e.g., if the original sheet is of A3 size, the length of the sheet on which Z-fold is produced is made equal to the length of an A4 size sheet).

When the sheet is a thin sheet (SH2), the folding loop counter needs to count up to the value obtained by adding the predetermined amount of count shift ΔP to the reference folding loop counter value Px (Step ST02-3 in FIG. 9).

The amount of count shift ΔP of the folding loop counter value is obtained by converting the amount of positional shift of the fold forming position (the length in the sheet conveyance direction and hence the sheet conveyance distance), which has been determined by tests conducted for each type of sheet having specific characteristics as described above, into the drive pulse count of the conveyance motor MT1. For this embodiment, not only the positional shifts arising to the fold forming position that are attributable to the types of sheet including ordinary sheet, thick sheet and thin sheet but also positional shifts that are expected to take place due to the characteristics of the sheets to be used in this embodiment are taken into consideration and the expected amounts of positional shifts are provided in advance. Then, the risk of shifting the position of the fold to be formed on the sheet can be dissolved or reduced by delaying the timing of driving the push plate 35 to start moving.

[Fold Forming Process]

First, the overall operation of the fold forming process will be described below in association with the movement of the push plate 35 in the above-described push process. When the folding loop counter counts up to the predetermined value and the push process is started in Step ST25, the registration roller pair 33 is continuously sending out the sheet and hence a desired loop L is being formed in the loop forming space 50 as shown in FIG. 7D.

The sheet SH is conveyed toward the folding roller pair 34, while it is being pushed at the predetermined position of the loop FL by the front end of the push plate 35 that has started to move from the retreat position. The part of the sheet SH located on the upstream side from the front end of the push plate 35 proceeds from the inclined part 45*c* of the upper conveyance guide 45 into below the second horizontal part 45*b* and passes through the narrow gap between the second horizontal part and the upper surface of the push plate 35, while its move is restricted from above. On the other hand, the part of the sheet SH located on the downstream side from the front end of the push plate 35 proceeds from the loop forming space 50 into between the push plate 35 and the second lower guide part of the lower conveyance guide 46 and is squeezed to show a profile that is inclined along the second inclined guide section 52*b* toward the upstream side.

As shown in FIG. 7E, as the front end of the push plate 35 gets into the linear section 66 of the third route section of the central conveyance path 42, the sheet SH is temporarily folded in the narrow gap between the second horizontal part 45*b* of the upper conveyance guide 45 and the second horizontal guide section 52*a* of the second lower guide part 46*b* to show a bent profile as it is forced to bend from upward and from downward with the push plate 35 pinched between the two parts of the sheet SH produced by the temporary folding. The sheet SH will further be pressed and folded later by the folding roller pair 34 at the temporarily bent and folded position to produce the second fold 203 of the sheet as shown in FIG. 6B.

When the push plate 35 is stopped at the push position 35", the folded position FP2 of the sheet SH is brought to a position located immediately in front of the nip section 39 of the folding roller pair 34 in the state of being bent as a result of the above-described temporary folding. As shown in FIG. 7F, the folded position FP2 of the sheet is driven and rolled into the nip section 39 of the folding roller pair 34 that is being driven to rotate by the folding motor MT2 and pressed and folded between the upper and lower folding rollers 34*a*, 34*b*, while being conveyed toward the downstream side. As a result of the press operation, the second fold F2 (203) is produced at the predetermined folding position of the sheet SH.

After temporarily and forcibly folding the sheet SH by bending the sheet SH into parts that are laid one on the other, the bent sheet SH is nipped and folded by the folding roller pair 34. Then, as a result, the second fold F2 is accurately and stably produced without giving rise to any positional shift that the prior art experienced. Furthermore, the risk that the second fold F2 is opened and the sheet is flattened is minimized and a nice-looking folded sheet is obtained.

Figure 12:
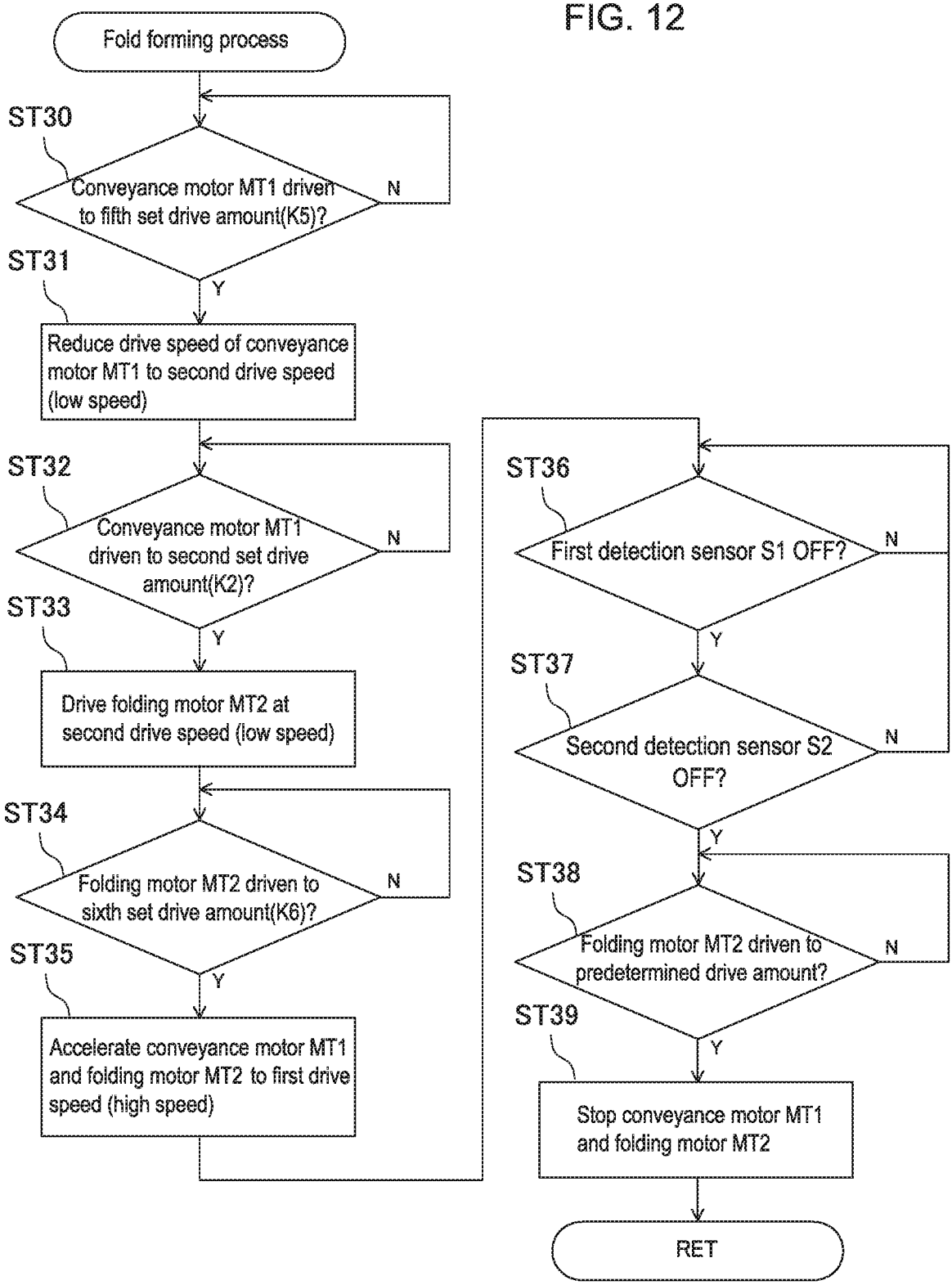
FIG. 12 is a flowchart of the fold producing process of the sheet folding apparatus.

Now, the sequence of operations of the fold forming process will be described by referring to the flowchart of FIG. 12. As described above, the registration roller pair 33 has been and being continuously driven to keep on rotating by the conveyance motor MT1 since before the push plate 35 started moving and the sheet conveying speed of the registration roller pair 33 is controlled so as to be the first conveyance speed V1, which is equal to the moving speed of the push plate 35. After starting to drive the push motor MT3 and when the drive amount of the conveyance motor MT1 gets to the fifth set drive amount (K5) (Y in Step ST30), the control section 120 reduces the drive speed of the conveyance motor MT1 to the second drive speed Vb so as to reduce the sheet conveying speed of the registration roller pair 33 to the second conveyance speed V2 (Step ST31).

As shown in FIG. 16, the speed reduction to the second conveyance speed V2 of the registration roller pair 33 precedes the speed reduction to the second moving speed V2 of the push plate 35 by the time period that corresponds to drive amount of the push motor MT3 that is equal to the seventh set drive amount (K7). During the time period from the speed reduction of the conveyance speed of the registration roller pair 33 to the delayed speed reduction of the moving speed of the push plate 35, the sheet SH is held in a state where it is tightly stretched between the front end of the push plate 35 that pushes the sheet SH and the registration roller pair 33. The delay time of the speed reduction of the moving speed of the push plate 35 is so selected that, even when the sheet is slackened due to the sheet characteristics (the degree of stiffness of the sheet) at the part of the sheet SH located on the upstream side relative to the front end of the push plate 35, the slackness of the sheet is dissolved and the sheet is brought into a tightly stretched state.

With the above-described arrangement, after the speed reduction of the push plate 35, the sheet SH is moved smoothly, horizontally and linearly to the above-described push position in a state where the part of the sheet located on the upstream side relative to the front end of the push plate 35 is supported by the upper surface of the push plate 35 and moved in synchronism with the move of the push plate 35. Therefore, during the time when the sheet SH is pushed and moved by the push plate 35, the risk that the push position of the push plate 35 is shifted from the predetermined position in the conveyance direction is dissolved. Furthermore, when the sheet SH gets to the push position, the profile of the part of the sheet that faces the nip section 39 of the folding roller pair 34 becomes substantially unchanged so that the fold position at which the sheet is nipped by the folding roller pair 34 and folded is substantially unshifted and hence the risk of shifting the position of the fold is dissolved or reduced.

When the drive amount of the conveyance motor MT1 gets to the second set drive amount (K2) (Y in Step ST32) after the speed reduction to the second speed v2 of the registration roller pair 33, the control section 120 drives the folding motor MT2 at the second drive speed Vb so as to make the folding roller pair 34 rotate at the second conveyance speed V2 (Step ST33). Then, as a result, the sheet SH is nipped at the folding position FP2 thereof that is being pushed by the front end of the push plate 35 by the nip section 39 of the folding roller pair 34, which is rotating at the low speed that is equal to the rotating speed of the registration roller pair 33, and laid on the front end part of the sheet SH that was nipped before to become firmly folded under pressure and produce the second fold 203 as shown in FIG. 7E. At this time, the front end part of the sheet SH that was nipped before by the folding roller pair 34 is sent out toward the downstream side by the folding roller pair 34 and becomes to operate as tab that projects from the second fold 203 of the folded sheet.

The driving operation of the folding motor MT2 is so controlled that the folding roller pair 34 starts rotating before the push plate 35 stops at the push position as shown in FIG. 16. The front end part of the sheet SH that was nipped before by the folding roller pair 3 is moved toward the downstream side at the low speed that is equal to the low moving speed of the push plate 35. Then, as a result, the extent (the amount of the tab) to which the front end projects from the second fold 203 of the folded sheet is minimized and hence the risk that the amount of the tab becomes variable is prevented from taking place.

Additionally, in this embodiment, the timing of starting driving the folding motor MT2 is set to be the time when the sheet SH gets into the third route section of the conveyance path 42, namely between the second horizontal part 45 of the upper conveyance guide 45 and the second lower guide part 46*b* of the lower conveyance guide 46 from the upstream side, by a predetermined distance. The part of the sheet SH located on the downstream side relative to the front end of the push plate 35 produces a loop for folding between itself and the front end part of the sheet and becomes bent and folded into two parts that are laid one on the other on the linear section 66 of the third route section. Therefore, when the push plate 35 gets into the third route section of the conveyance path 42, the lower part of the sheet is pushed out toward the downstream side due to the friction between itself and the upper part of the sheet to give rise to a risk that the front end part of the sheet is shifted toward the downstream side from the position where it was nipped by the folding roller pair 34. In this embodiment, the position of the push plate 35 at which it can shift the front end position of the sheet was observed in the experiments that were conducted in advance and the above-described timing of starting driving the folding motor MT2 is set on the basis of the results of the experiments.

Next, when the drive amount of the folding motor MT2 gets to the sixth set drive amount (K6) after starting driving the folding motor MT2 (Y in Step ST34), the control section 120 accelerates both the conveyance motor MT1 and the folding motor MT2 up to the first drive speed Va so as to raise the sheet conveying speed of the registration roller pair 33 and the folding roller pair 34 to the first conveyance speed V1 (Step ST35). Then, as a result, as illustrated in FIG. 7F, the folded position FP2 of the sheet SH is rolled into the nip section 39 of the folding roller pair 34 and pressed and folded between the upper and lower rollers 34*a*, 34*b* as the sheet SH is conveyed toward the downstream side. As a result of the press operation, the second fold FP2 (203) is produced at the predetermined position of the sheet.

On the other hand, the control section 120 executes a second retreat process of bringing the push plate 35 from the push position 35" back to the retreat position so as not to interfere with the above-described operation of rolling the sheet into the nip section 39 of the folding roller pair 34.

This second retreat process will be described in greater detail below by referring to FIG. 14.

The folding roller pair 34 is kept on being driven to rotate after the retreat process of the push plate 35. Thus, as shown in FIG. 7F, the sheet is kept on being nipped by the folding roller pair 34 and conveyed toward the downstream side on the sheet carry-out path 43 in a state where the sheet is folded into three parts to produce Z-fold and the front end and the second fold F2 formed by the folding roller pair 34 precede the remaining parts of the sheet.

As the sheet is conveyed on, the loop for folding FL in the loop forming space 50 is gradually made smaller and smaller. The loop FL gets into the third route section of the conveyance path 42 and squeezed from above and from below by the second horizontal part 45*b* of the upper conveyance guide 45 and the second inclined guide section 52*b* of the second lower guide part 46*b* to become a low profile loop that extends in the sheet conveyance direction. Furthermore, the loop for folding FL proceeds into between the second horizontal part 45*b* and the second horizontal guide section 52*a* of the second lower guide part 46*b* and is properly folded from above and from below at the rear end fold position FP1 (on the upstream side) to become the first fold.

Thus, the sheet is conveyed in the conveyance direction with its folded form produced at the fold position FP1 without any risk of slipping and/or positionally shifting the fold between the upper part laid on the lower part and the lower part laid under the upper part and then pressed and folded by the nip section 39 of the folding roller pair 34. Therefore, the first fold (202 in FIG. 6B) is formed reliably and accurately at the desired position without any positional shift that the prior art experienced.

Thus, consequently, as shown in FIG. 6B, Z-fold is produced on the sheet SH by inwardly folding the sheet for the first fold 202 and then outwardly folding the sheet for the second fold 203. In this embodiment, a loop for folding FL is produced in a state where a front end part of the sheet is nipped by the folding roller pair 34 whose rotatory motion is suspended and subsequently the folding roller pair 34 is driven to rotate again to produce the second fold and the first fold as described above. Therefore, when Z-fold is produced, the sheet SH brought into a state where the front end part of the sheet that was nipped during the operation of producing the loop for folding FL is sticking out toward the front end side (downstream side) from the second fold.

Thus, with this embodiment, the folding roller pair 34 is driven to rotate at the low speed to press and fold the sheet as described above so that the second fold 203 can be produced by folding the sheet without any risk of allowing the second fold 203 to become open and expand. Additionally, the sheet conveyance speed of the registration roller pair 33 and the folding roller pair 34 is controlled to the low conveyance speed when the push plate 35 gets into the linear section 66 of the third route section and hence, even if the load applied to the conveyance motor MT1 and the load applied to the folding motor MT2 are increased as the sheet is conveyed toward the downstream side in a state of being folded under the lower surface of the push plate 35, any step-out of either or both of those roller pairs can be prevented from taking place.

After accelerating the registration roller pair 33 and the folding roller pair 34 to the first speed V1 (Step ST35), when the rear end of the sheet having Z-fold produced by forming the first fold 202 and the second fold 203 is detected by the first detection sensor S1 and the second detection sensor S2 and both the sensors S1 and S2 are turned off (Y in Step ST36 and Y in Step ST37), the control section 120 counts the drive amount of the folding motor MT2. When the drive amount of the folding motor MT2 gets to the predetermined drive amount (Y in Step ST38), the control section 120 judges that the rear end of the sheet H, namely the upstream side end of the sheet as viewed in the sheet conveyance direction, has passed the folding roller pair 34 and stops both the conveyance motor MT1 and the folding motor MT2 (Step ST39). Then, as a result, both the registration roller pair 33 and the folding roller pair 34 stop rotating.

As the first detection sensor S1 detects the rear end of the sheet having Z-fold and becomes turned off, the control section 120 executes the guide process of moving the push plate 35 from the retreat position to the guide position 35'. It is so set in advance that the loop for folding FL has already passed through the folding roller pair 34 at this time. Therefore, the push plate 35 that is moved to the guide position 35' does not interfere at all with the operation of conveying the sheet SH on the conveyance path 42 and the fold forming process by the folding roller pair 34.

[Second Retreat Process]

Since the second retreat process is executed in a manner similar to the retreat process described above by referring to FIG. 14, this process will also be described below by referring to FIG. 14. In the state illustrated in FIG. 7E, when a predetermined time period has elapsed after the push plate 35 stops at the push position 35", the control section 120 drives the push motor MT3 to rotate reversely to move the push plate 35 horizontal toward the upstream side as viewed in the sheet conveyance direction up to the retreat position (Step ST50). As the third detection sensor S3 arranged below the first lower guide part 46*a* detects the detection flag of the push late 35 and becomes turned on (Y in Step ST51), the control section 120 stops the push motor MT3. Then, as a result, the push plate 35 is placed at the retreat position as shown in FIG. 7F.

At this time, the gap 48 of the conveyance path 42 located between the first and second lower guide parts 46*a*, 46*b* is completely opened and the loop forming space 50 located below the second route section of the conveyance path 42 is exposed. Thus, the loop FL can continuously and smoothly be drawn into the nip section 39 of the folding roller pair 34 from the very start of the drawing operation as shown in FIG. 7E without being obstructed by the push plate 35.

[Guide Process]

Figure 15:
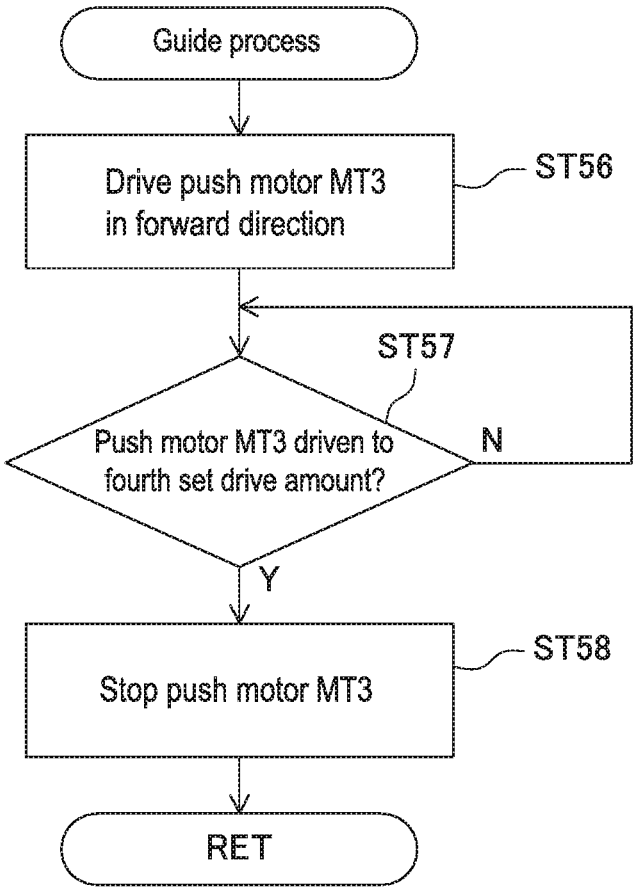
FIG. 15 is a flowchart of the guide process of the push plate of the sheet folding apparatus.

The above-described guide process is executed typically by following the sequence of the flowchart shown in FIG. 15. First, the push motor MT3 is driven to rotate in the forward direction (Step ST56) to move the push plate 35 horizontally toward the folding roller pair 34. When the drive amount of the push motor NT3 gets to the predetermined third set drive amount (Y in Step ST57), the control section 120 stops the push motor MT3 (Step ST58).

Note that the third set drive amount is the drive amount of the push motor MT3 that is required to move the push plate 35 from the retreat position to the guide position 35'. Then, as a result, the gap 48 between the first and second lower guide parts 46*a*, 46*b* is closed by the push plate 35 and the rear end of the sheet is guided by the upper surface of the push plate 35 on the conveyance route 42 and conveyed straight toward the folding roller pair 34. The amount of rotatory motion of the push motor NT3 (the number of rotations of the rotary shaft, the angle of rotation of the rotary shaft, the duration of time of rotatory motion or the like) can be used for the drive amount of the push motor MT3.

The present invention has been described above by referring to currently preferable embodiments of the invention, the present invention is by no means limited to the above-described embodiments, which can be altered, modified or deformed in various different ways without departing from the technological scope of the present invention.

As pointed out above, while the present invention has been described by referring to currently preferable embodiments of the invention, the present invention is by no means limited to the above-described embodiments, which can be altered, modified or deformed in various different ways without departing from the technological scope of the present invention.

This application claims the benefit of Japanese Patent Applications Nos. 2018-230530 and 2018-230529, filed Dec. 10, 2018 and Japanese Patent Applications Nos. 2018-245123, 2018-245124 and 2018-245125, filed Dec. 27, 2018, all of which are hereby incorporated by reference herein in their entireties.

What is claimed is:

1. A sheet folding apparatus for folding a sheet, the apparatus comprising:

a folding roller pair for nipping a sheet at a predetermined position of the sheet and folding the sheet;

a conveyance roller for conveying the sheet to the folding roller pair;

a push member to be moved from a retreat position separated from the sheet to a push position for pushing the sheet at a predetermined position of the sheet and causing the folding roller pair to nip the sheet; and a control section for controlling operation of driving the conveyance roller and operation of moving the push member, the control section operating so as to move the push member to the push position while conveying the sheet by means of the conveyance roller, wherein the control section makes sheet conveying speed of the conveyance roller and moving speed of the push member to be moved to the push position agreed with each other.

2. A sheet folding apparatus for folding a sheet, the apparatus comprising:

a folding roller pair for nipping a sheet at a predetermined position of the sheet and folding the sheet;

a conveyance roller for conveying the sheet to the folding roller pair;

a push member to be moved from a retreat position separated from the sheet to a push position for pushing the sheet at a predetermined position of the sheet and causing the folding roller pair to nip the sheet; and a control section for controlling operation of driving the conveyance roller and operation of moving the push member, the control section operating so as to move the push member to the push position while conveying the sheet by means of the conveyance roller, wherein the control section temporarily reduces a sheet conveying speed of the conveyance roller from a speed that agrees with a moving speed of the push member to a speed that is lower than the moving speed of the push member.

3. The sheet folding apparatus according to claim 2, wherein the control section reduces the sheet conveying speed of the conveyance roller and the moving speed of the push member from a first conveyance speed to a second feeding speed that is lower than the first conveyance speed and makes a timing of reducing the moving speed of the push member come later than a timing of reducing the sheet conveying speed of the conveyance roller.

4. The sheet folding apparatus according to claim 2, further comprising an information acquisition section for acquiring information on a thickness of the sheet, wherein the control section identifies the thickness of the sheet according to the information on the thickness of the sheet acquired by the information acquisition section, and controls the sheet conveying speed of the conveyance roller and the moving speed of the push member so as to make them agree with each other when the identified thickness of the sheet is not smaller than a predetermined value, whereas the control section controls the sheet conveying speed of the conveyance roller so as to temporarily reduce the sheet conveying speed of the conveyance roller from the speed that agrees with the moving speed of the push member to a speed that is lower than the moving speed of the push member when the identified thickness of the sheet is smaller than the predetermined value.

5. A sheet folding apparatus for folding a sheet, the apparatus comprising:

a conveyance roller for conveying a sheet;

a folding roller pair for nipping the sheet at a predetermined position of the sheet and folding the sheet;

a conveyance route extending from the conveyance roller to the folding roller pair;

a space section for allowing a part of the sheet to hang downward from the conveyance route;

a push member for pushing the sheet hanging down from the conveyance route into the space section at a predetermined position of the sheet and moving to a push position for causing the folding roller pair to nip the sheet at the predetermined position of the sheet; and a control section for controlling operation of driving the conveyance roller and operation of moving the push member so as to move the push member to the push position, while making the conveyance roller keep on conveying the sheet, a guide section arranged between the conveyance roller and the space section to support the sheet hanging down into the space section, wherein the push member is arranged so as to push the sheet hanging down from the guide section into the space section at a position of the sheet located close to a downstream side end of the guide section.

6. A sheet folding apparatus for folding a sheet, the apparatus comprising:

a conveyance roller for conveying a sheet;

a folding roller pair for nipping the sheet at a predetermined position of the sheet and folding the sheet;

a conveyance route extending from the conveyance roller to the folding roller pair;

a space section for allowing a part of the sheet to hang downward from the conveyance route;

a push member for pushing the sheet hanging down from the conveyance route into the space section at a predetermined position of the sheet and moving to a push position for causing the folding roller pair to nip the sheet at the predetermined position of the sheet;

a control section for controlling operation of driving the conveyance roller and operation of moving the push member so as to move the push member to the push position, while making the conveyance roller keep on conveying the sheet, and an information acquisition section for acquiring information on a thickness of the sheet, wherein the control section makes a timing of starting moving the push member vary according to the information on the thickness of the sheet acquired by the information acquisition section.

7. The sheet folding apparatus according to claim 6, wherein the control section identifies the thickness of the sheet according to the information on the thickness of the sheet acquired by the information acquisition section and, when the thickness of the sheet is not greater than a predetermined thickness, it makes the timing of starting moving the push member come later than the timing of starting moving the push member when the thickness of the sheet is greater than the predetermined value.

8. The sheet folding apparatus according to claim 6, wherein the control section identifies the thickness of the sheet according to the information acquired by the information acquisition section and starts moving the push member at a time point that a feed amount of the sheet being fed by the conveyance roller gets to a first feed amount when the thickness of the sheet is greater than a predetermined sheet thickness, whereas the control section starts moving the push member at the time point that the feed amount of the sheet being fed by the conveyance roller gets to a second feed amount greater than the first feed amount when the thickness of the sheet is not greater than the predetermined sheet thickness.

9. A sheet folding apparatus for folding a sheet, the apparatus comprising:

a conveyance roller for conveying a sheet;

a folding roller pair for nipping the sheet at a predetermined position of the sheet and folding the sheet;

a conveyance route extending from the conveyance roller to the folding roller pair;

a space section arranged under the conveyance route to allow the sheet to form a loop between the conveyance roller and the folding roller pair;

a push member for pushing the sheet having a loop formed thereon at a predetermined position of the sheet and moving the predetermined position of the sheet to a push position for causing the folding roller pair to nip the sheet at the predetermined position of the sheet; and a control section for controlling operation of driving the conveyance roller and operation of moving the push member;

wherein the control section operates so as to convey the sheet to the conveyance roller in order to form a loop on the sheet in a state where the folding roller pair nips the sheet and, after forming the loop, move the push member to the push position while keeping on conveying the sheet by means of the conveyance roller, and the control section controls operation of driving the folding roller pair so as to bring back the front end of the sheet that is nipped by the folding roller pair by a predetermined amount toward an upstream side as viewed in the sheet conveyance direction prior to the operation by the push member of pushing the sheet.

* * * * *